US010543680B2

(12) United States Patent
Fukasawa et al.

(10) Patent No.: US 10,543,680 B2
(45) Date of Patent: Jan. 28, 2020

(54) INKJET PRINTING APPARATUS AND EJECTING METHOD

(71) Applicant: CANON KABUSHIKI KAISHA, Tokyo (JP)

(72) Inventors: Takuya Fukasawa, Kawasaki (JP); Takatoshi Nakano, Yokohama (JP); Atsushi Takahashi, Tama (JP); Yoshinori Nakagawa, Kawasaki (JP); Hiroshi Nakai, Sagamihara (JP); Noriko Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/024,973

(22) Filed: Jul. 2, 2018

(65) Prior Publication Data

US 2019/0009522 A1 Jan. 10, 2019

(30) Foreign Application Priority Data

Jul. 7, 2017 (JP) ..... 2017-133533

(51) Int. Cl.
*B41J 2/045* (2006.01)
*B41J 2/165* (2006.01)
(Continued)

(52) U.S. Cl.
CPC ..... *B41J 2/04501* (2013.01); *B41J 2/16505* (2013.01); *B41J 2/16535* (2013.01); *B41J 2/18* (2013.01); *B41J 2/21* (2013.01)

(58) Field of Classification Search
CPC ..... B41J 2/16508; B41J 2/16517; B41J 2/16526; B41J 2/16588; B41J 2/16505;
(Continued)

(56) References Cited

U.S. PATENT DOCUMENTS 6,984,009 B2 1/2006 Nakagawa et al.
6,994,416 B2 2/2006 Seki et al.
(Continued)

FOREIGN PATENT DOCUMENTS

JP 2010064411 A 3/2010
JP 2010158845 A 7/2010
JP 2014151624 A 8/2014

OTHER PUBLICATIONS

GB Search Report issued in corresponding GB Application No. 1811112.0 dated Jan. 7, 2019.
(Continued)

*Primary Examiner* — Anh T Vo
(74) *Attorney, Agent, or Firm* — Venable LLP

(57) ABSTRACT

There is provided an inkjet printing apparatus including: a print head having an ejection opening surface on which a first ejection opening array capable of ejecting a first ink and a second ejection opening array capable of ejecting a second ink are arranged; a cap member; and a print controller configured to cause the first and the second ejection opening arrays to perform preliminary ejection to an inside of the cap member, and to cause the first ejection opening array to perform preliminary ejection in a first relative position and cause the second ejection opening array to perform preliminary ejection in a second relative position, wherein, on the cap member, a position in which the second ink lands by the preliminary ejection overlaps with an area where the first ink lands by the preliminary ejection.

15 Claims, 18 Drawing Sheets

(51) Int. Cl.
*B41J 2/18* (2006.01)
*B41J 2/21* (2006.01)

(58) Field of Classification Search
CPC ... B41J 2/18; B41J 2/21; B41J 2/16535; B41J 2/04501; B41J 29/02
See application file for complete search history.

(56) References Cited

U.S. PATENT DOCUMENTS 7,011,386 B2 3/2006 Iwasaki et al.
7,144,096 B2 12/2006 Seki et al.
7,396,095 B2 7/2008 Nakagawa et al.
7,810,848 B2 * 10/2010 Yoshino ..... F16L 37/098 285/305
7,896,463 B2 3/2011 Nakagawa et al.
8,033,658 B2 * 10/2011 Kachi ..... B41J 2/19 347/92
8,752,930 B2 6/2014 Doi et al.
8,827,419 B2 9/2014 Nakagawa et al.
8,882,240 B2 * 11/2014 Hirosawa ..... B41J 2/1652 347/19
8,944,562 B2 2/2015 Nakagawa et al.
9,096,065 B2 8/2015 Nakano et al.
9,108,410 B2 8/2015 Hamasaki et al.
9,387,679 B2 7/2016 Shiiba et al.
9,446,595 B2 9/2016 Takarabe et al.
9,517,628 B2 12/2016 Tenkawa et al.
9,862,195 B2 1/2018 Genta et al.
2003/0067506 A1 4/2003 Rotering
2004/0041862 A1 3/2004 Nakagawa et al.
2009/0091593 A1 4/2009 Sakurai
2010/0321425 A1 * 12/2010 Kanke ..... B41J 2/1652 347/6
2013/0100200 A1 4/2013 Hamasaki et al.
2015/0124018 A1 5/2015 Yoshida
2016/0052278 A1 2/2016 Iwasaki et al.
2016/0089887 A1 3/2016 Shindo
2018/0001623 A1 1/2018 Nakano et al.
2018/0022086 A1 1/2018 Kameshima et al.
2018/0079218 A1 3/2018 Genta et al.
2018/0154630 A1 6/2018 Takahashi et al.

OTHER PUBLICATIONS

Copending, unpublished U.S. Appl. No. 15/955,005 to Takahiro Kiuchi et al., filed Apr. 17, 2018.
Copending, unpublished U.S. Appl. No. 15/955,813 to Hiroshi Nakai et al., filed Apr. 18, 2018.
Copending, unpublished U.S. Appl. No. 16/021,116 to Takuya Fukasawa et al., filed Jun. 28, 2018.
Copending, unpublished U.S. Appl. No. 16/024,977 to Hiroshi Nakai et al., filed Jul. 2, 2018.
Copending, unpublished U.S. Appl. No. 16/027,552 to Noriko Sato et al., filed Jul. 5, 2018.
Copending, unpublished U.S. Appl. No. 16/023,007 to Takuya Fukasawa et al., filed Jun. 29, 2018.
Copending, unpublished U.S. Appl. No. 16/052,997 to Yoshinori Nakagawa et al., filed Aug. 2, 2018.

* cited by examiner

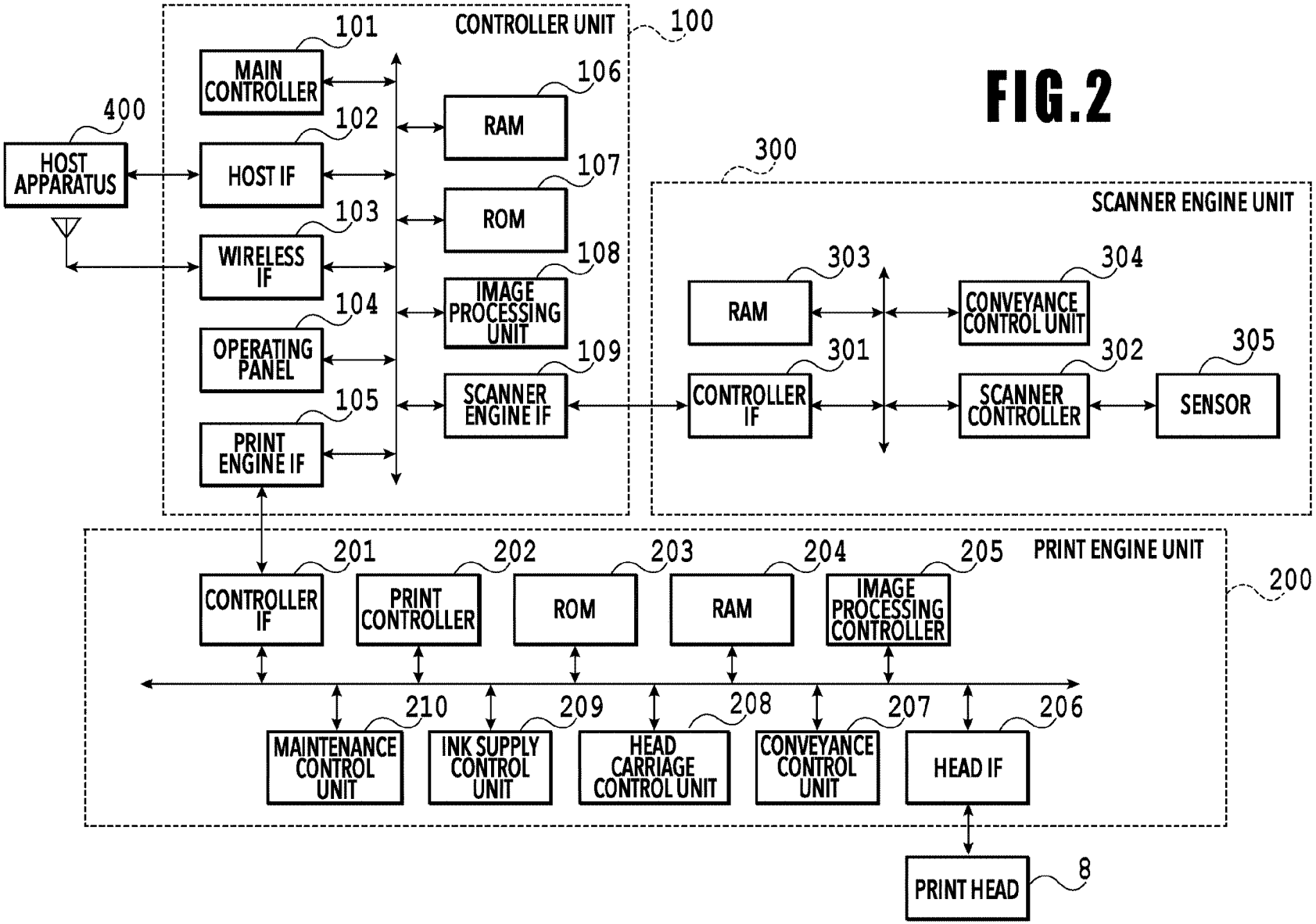
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
RAM
303
CONTROLLER IF
301
CONVEYANCE CONTROL UNIT
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
HEAD IF
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8

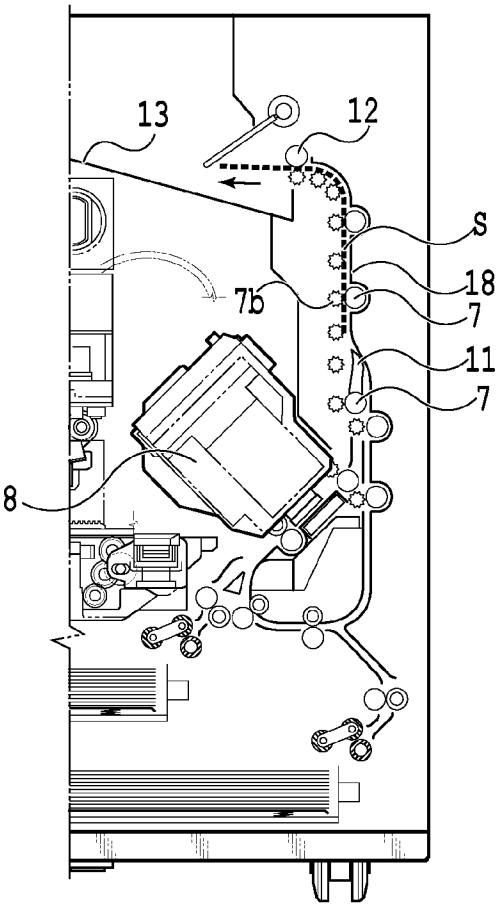
FIG.4C
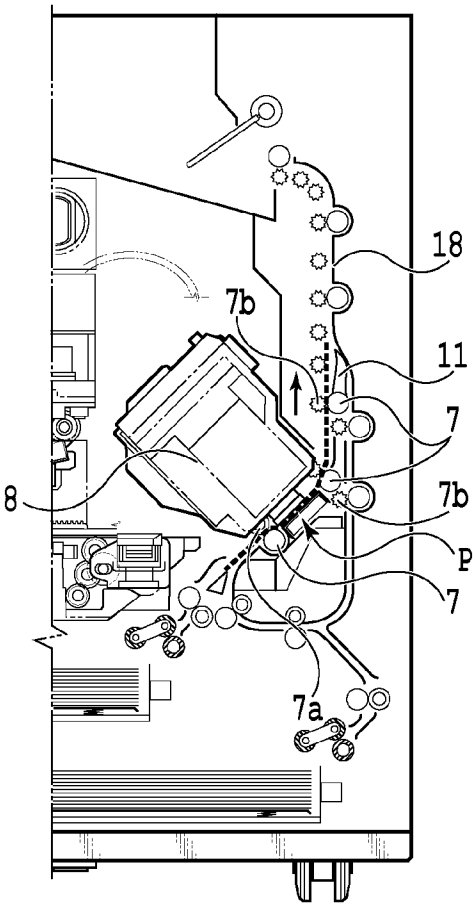
FIG.4B
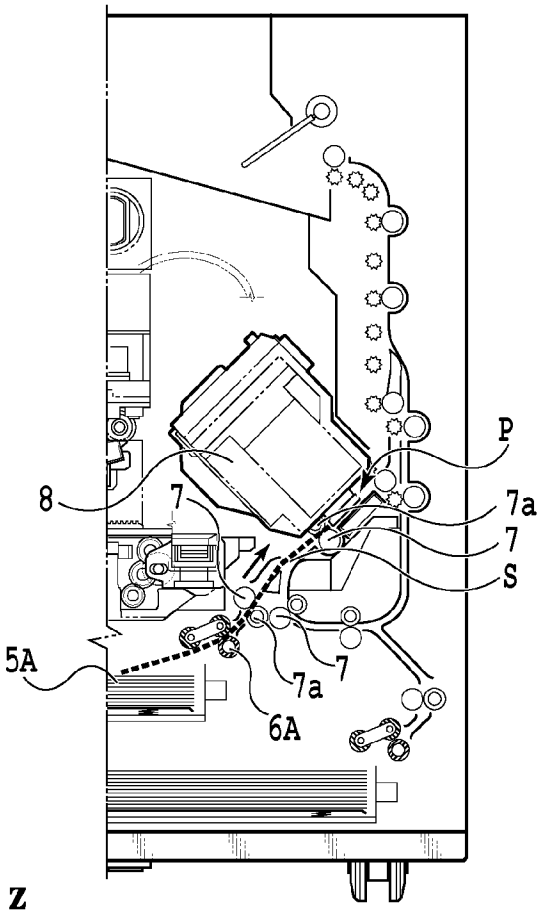
FIG.4A
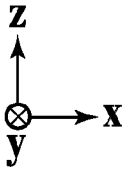

INKJET PRINTING APPARATUS AND EJECTING METHOD

BACKGROUND OF THE INVENTION

Field of the Invention

The present invention relates to an inkjet printing apparatus and an ejecting method.

Description of the Related Art

Some liquid ejecting apparatuses such as inkjet printing apparatuses have a print head (a so-called line head) having ejection openings corresponding to the size of a width of a print medium. In such a print head (line head), ejection openings are arranged in a manner extending in a width direction of a print medium. Japanese Patent Laid-Open No. 2010-158845 (hereinafter referred to as PTL 1) discloses a purging mechanism for maintenance, in which after wiping an ejection opening surface of the line head, a predetermined amount of ink is ejected and then the ejected ink is sucked.

Some inks may easily accumulate and some inks may not easily accumulate. In the technique of PTL 1, a positional relation of landing between inks ejected during maintenance is the same as a positional relation between ejection openings arranged on the line head. Therefore, depending on a combination of inks or an arrangement relation among ejection openings, inks ejected during maintenance may accumulate, causing difficulty in performing an ink discharging process.

SUMMARY OF THE INVENTION

According to an aspect of the present invention, there is provided an inkjet printing apparatus including: a print head having an ejection opening surface on which a first ejection opening array capable of ejecting a first ink to a print medium and a second ejection opening array capable of ejecting a second ink to a print medium are arranged; a cap member configured to cap the first ejection opening array and the second ejection opening array; and a print controller configured to cause the first ejection opening array and the second ejection opening array to perform preliminary ejection to an inside of the cap member; the print controller configured to cause the first ejection opening array to perform preliminary ejection in a first relative position and cause the second ejection opening array to perform preliminary ejection in a second relative position that is different from the first relative position, wherein, on the cap member, a position in which the second ink lands by the preliminary ejection overlaps with an area where the first ink lands by the preliminary ejection.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
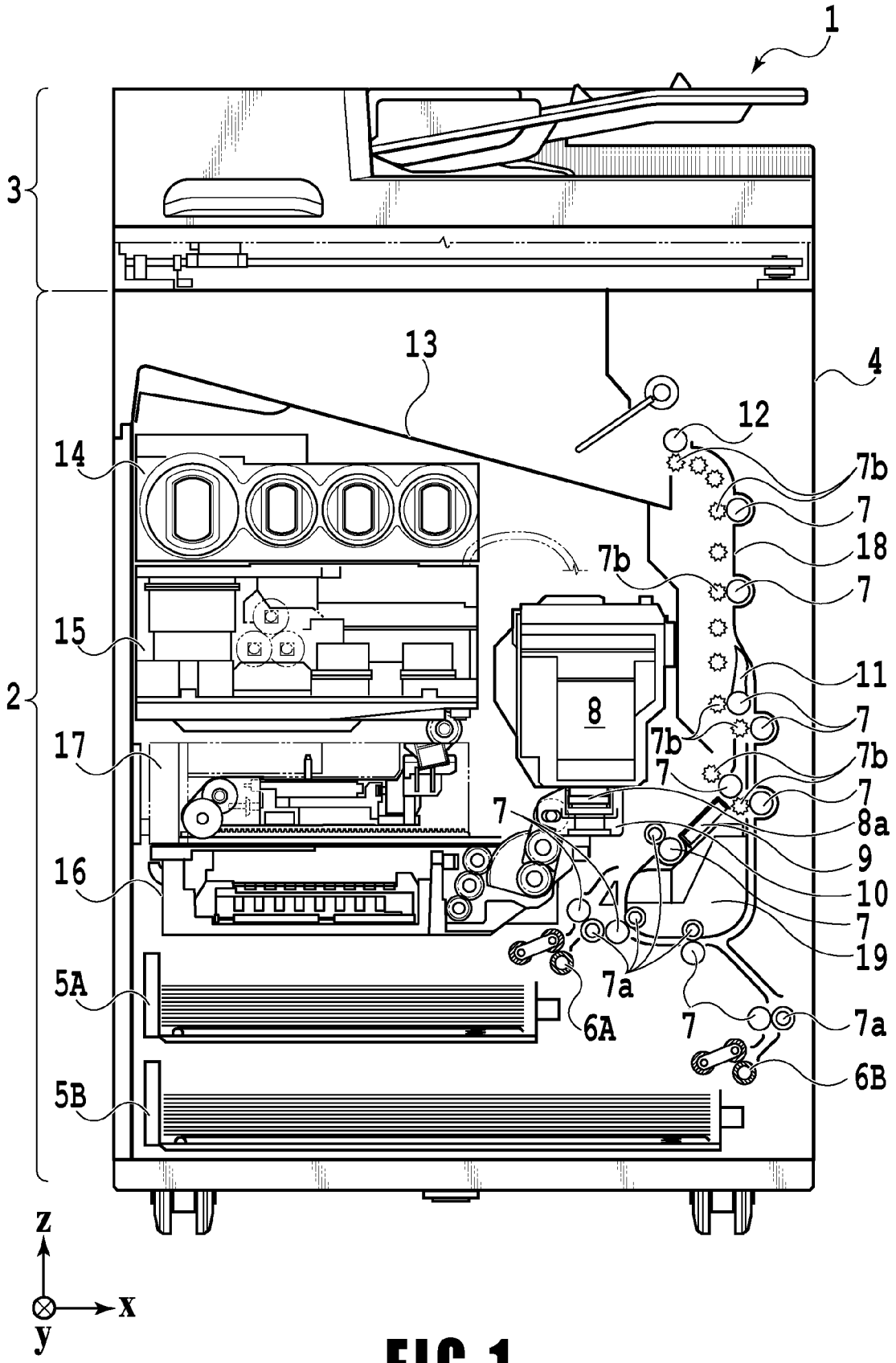
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In FIG. 1, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted.

FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
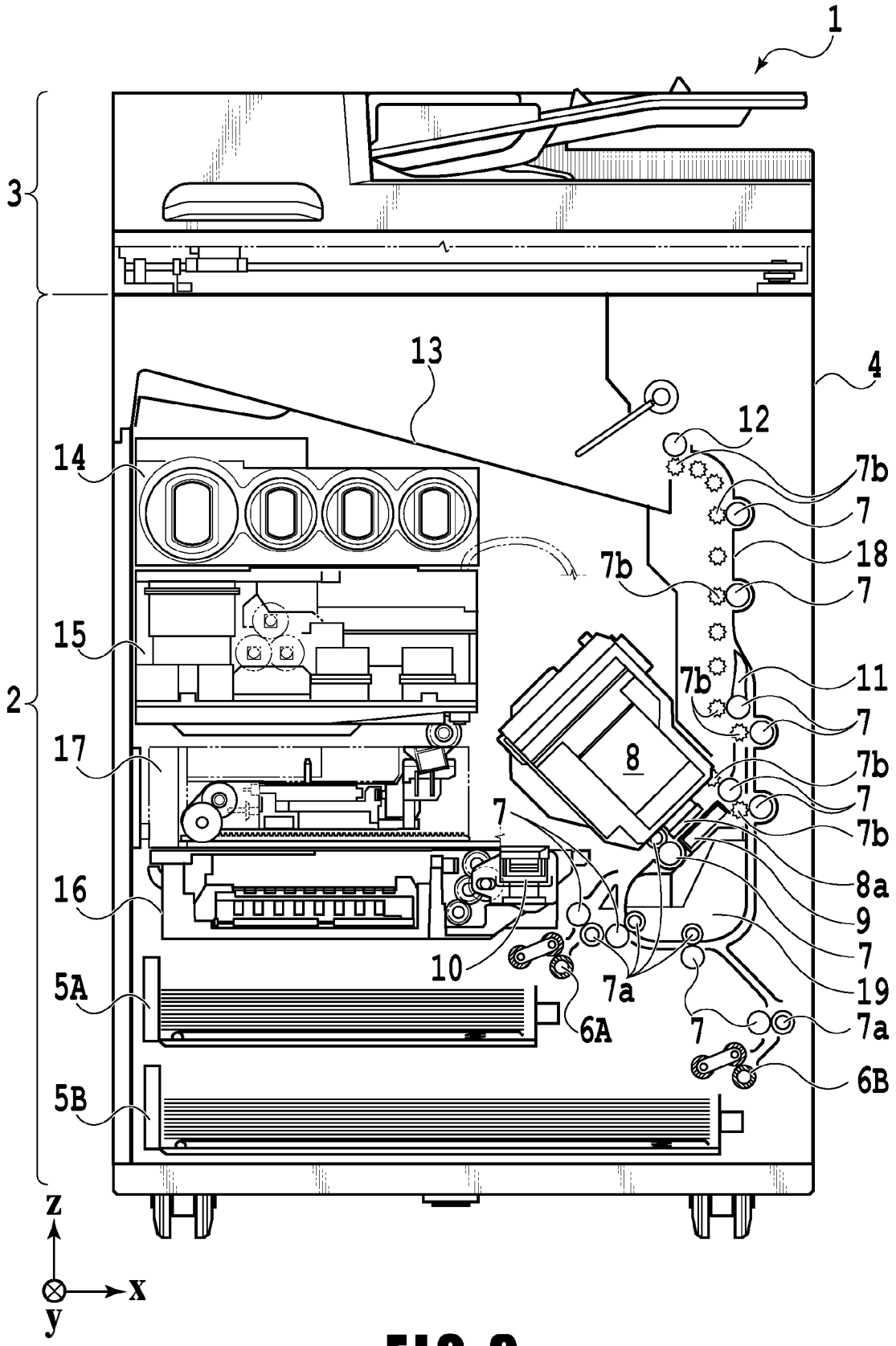
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
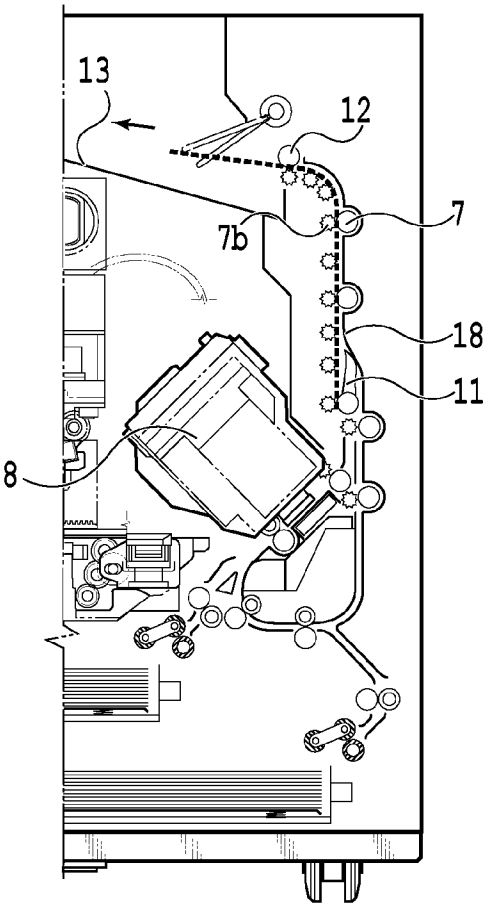
FIGS. 5A to 5C are conveying path diagrams of a print medium fed from a second cassette.
Figure 5B:
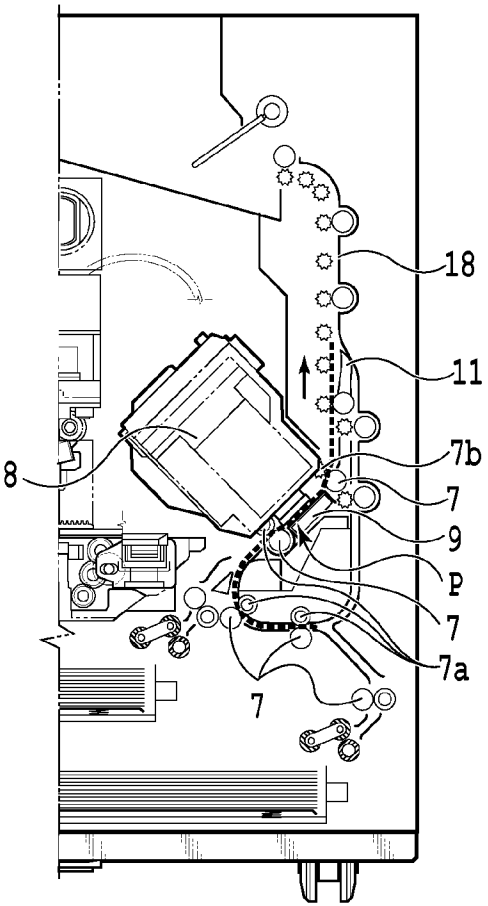
Figure 5A:
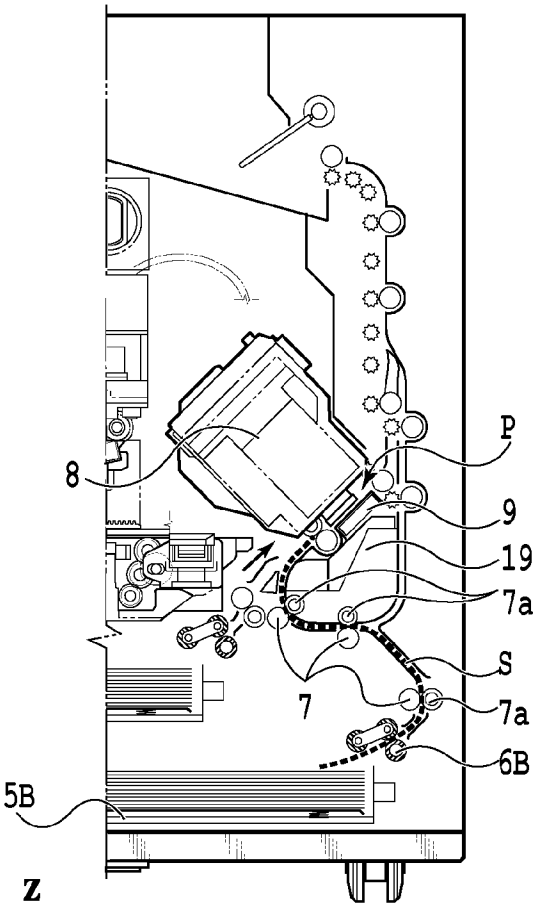

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
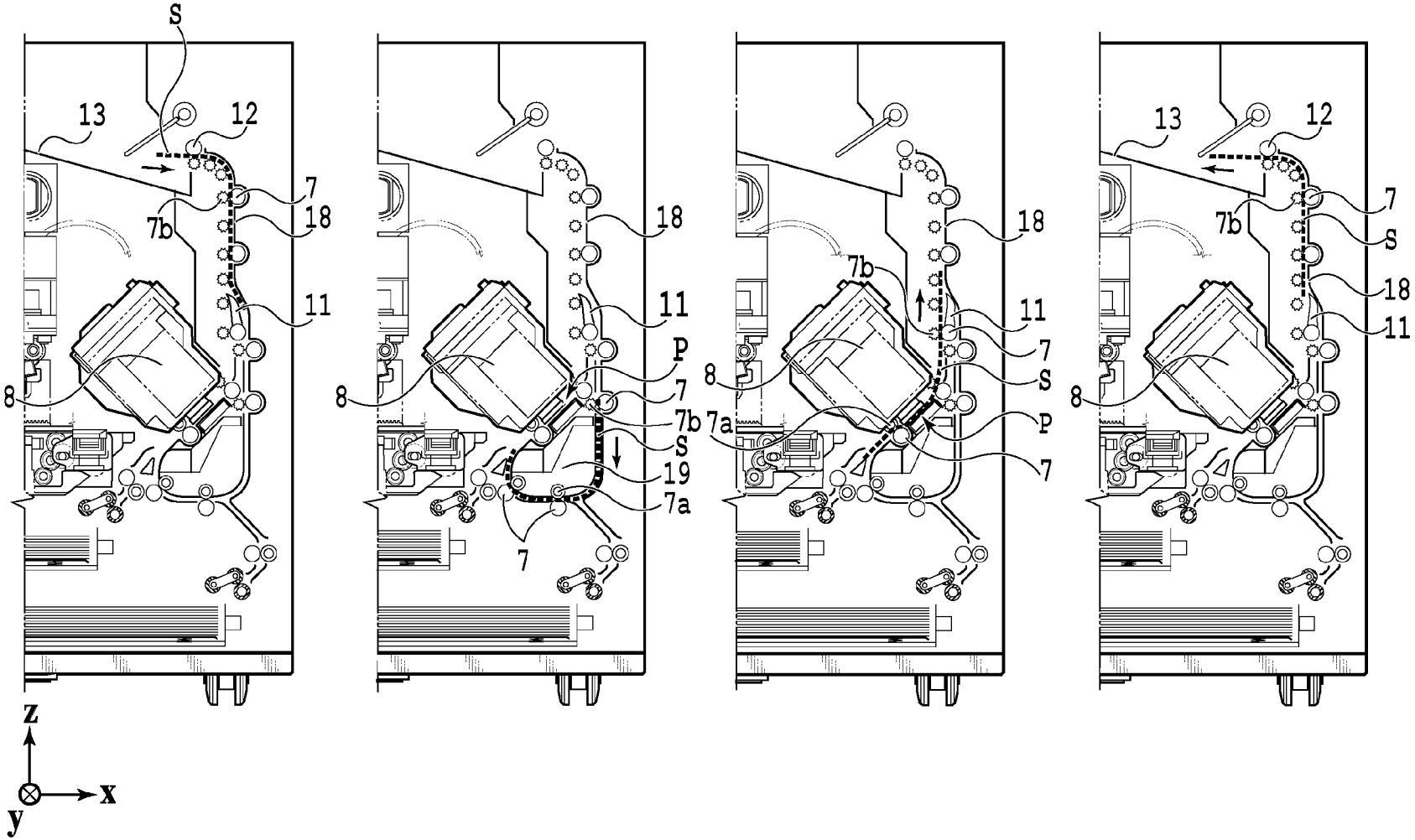
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

<<Maintenance Operation>>

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
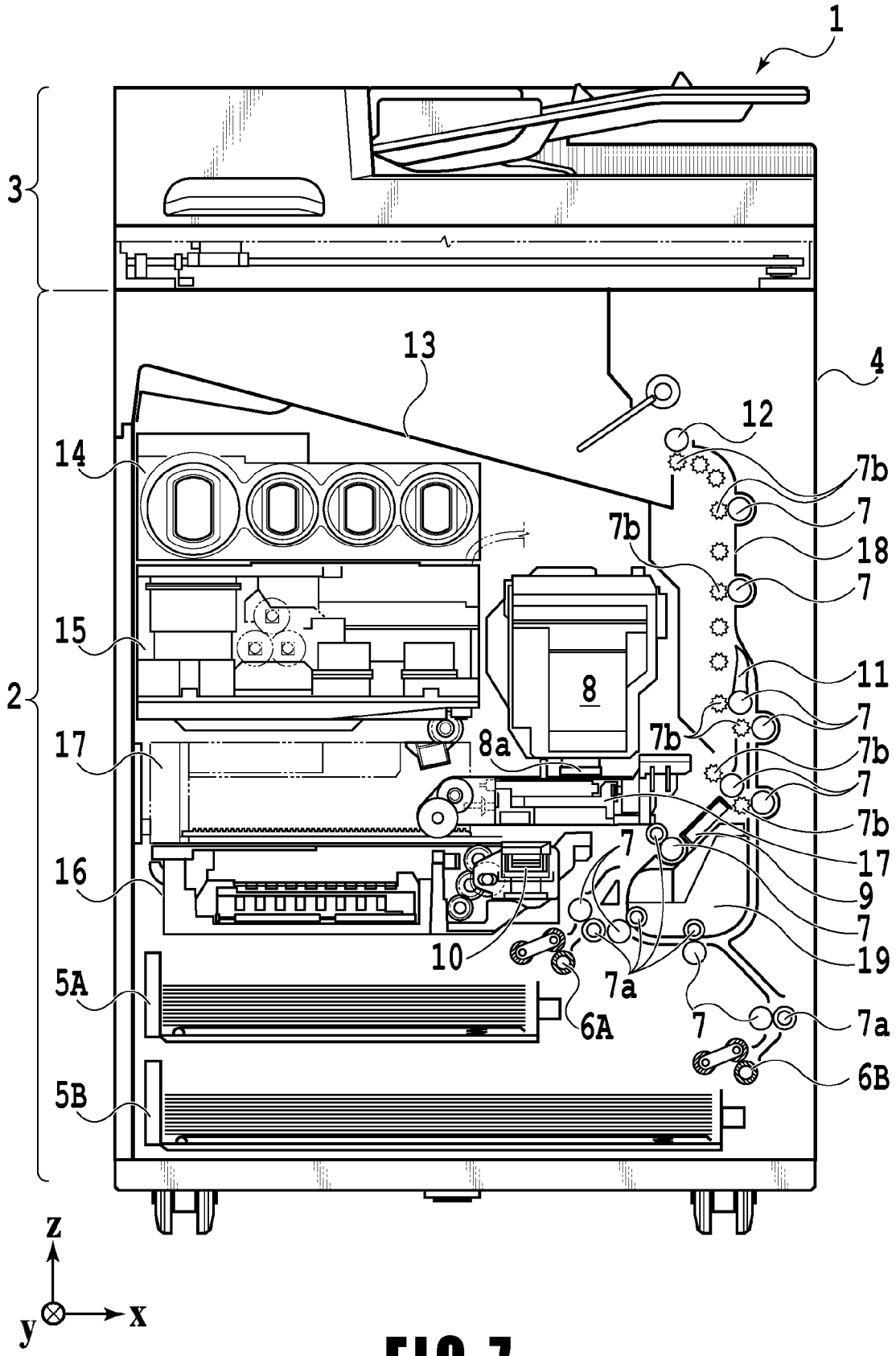
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
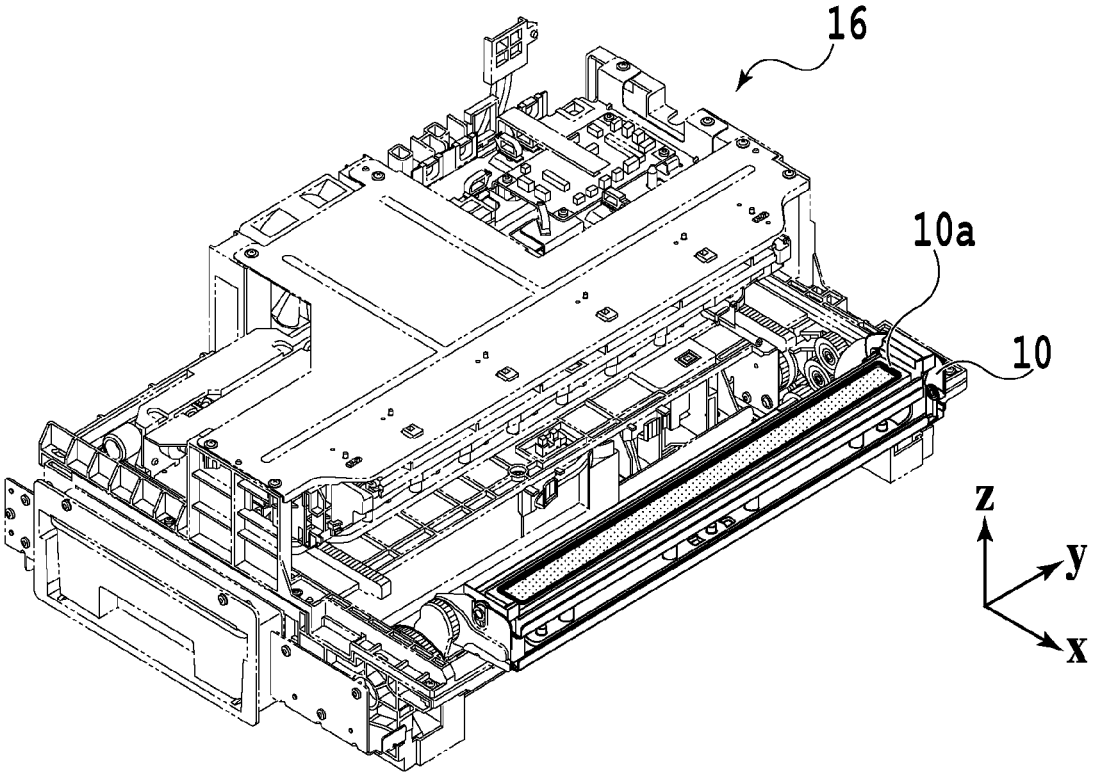
FIGS. 8A and 8B are perspective views showing the configuration of a maintenance unit.
Figure 8B:
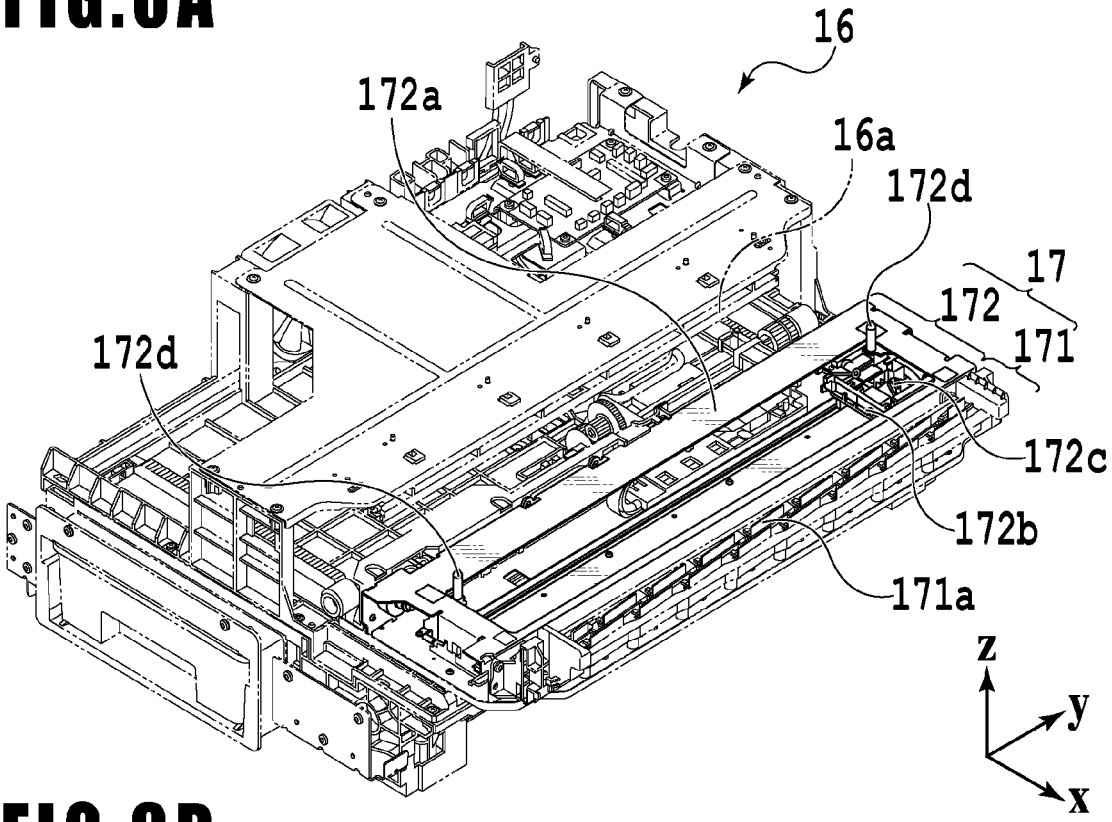

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the print head 8 to perform preliminary ejection into the cap member and allows the suction pump to perform suction operation of collected ink in the same manner as the first wiping process.

<Regarding Preliminary Ejection>

Next, a detailed description will be given of a process of preliminary ejection after performing the wiping process in the present embodiment. The preliminary ejection serves to discharge mixed color ink that is forced into the ejection openings through the wiping process. In the present embodiment, the preliminary ejection is performed after the above-described first wiping process or second wiping process. The preliminary ejection is performed in a manner corresponding to the operation of sequentially wiping the ejection opening arrays in the wiping process. Furthermore, the preliminary ejection serves to discharge mixed color ink that is drawn into the ejection openings from the ejection opening surface 8*a* near the ejection openings. The actual preliminary ejecting operation is an operation of discharging ink in a position irrespective of printing, and in the present embodiment, ink is discharged to the cap member 10*a*. As a result of the preliminary ejection, the ink adhering to the vicinity of the ejection openings is discharged, thereby suppressing color mixing in the ejection openings.

Incidentally, some inks may easily accumulate and some inks may not easily accumulate. Such characteristics of ink regarding accumulation depend on whether the ink may easily thicken by coming into contact with air. More specifically, it is known that ink containing pigment in a large amount may easily thicken. The ink in the ejection openings tends to thicken from a portion being in contact with air, and the preliminary ejection also serves to discharge thickened ink. In the present embodiment, black ink may thicken more easily compared to color inks such as cyan, magenta, and yellow. In a case where ink that may easily thicken like the black ink is preliminarily ejected onto the cap member 10*a*, it is known that such ink may easily accumulate on the cap member 10*a*.

Now, it is assumed that in the preliminary ejecting operation, a relative position between the print head 8 and the cap member 10*a* is fixed. In this case, a positional relation between inks landing on the cap member 10*a* is the same as the positional relation between the ejection opening arrays of inks. Accordingly, while color ink may not accumulate, the black ink may accumulate on the cap member 10*a*. In a case where ink accumulates on the cap member 10*a*, the suction pump may not suck the ink, causing difficulty in performing a discharging process. In this occasion, there is a need for preventing preliminarily ejected ink from accumulating on the cap member 10*a*.

In the present embodiment, the positional relation between preliminarily ejected inks landing on the cap member 10*a* is controlled to be different from the positional relation between the ejection opening arrays of inks in the print head 8. More specifically, the number of relative positions between the print head 8 and the cap member 10*a* in the case of preliminary ejection is not fixed at one. The print head 8 and the cap member 10*a* in the case of preliminary ejection are controlled to be at least two different relative positions. Then, preliminary ejection is performed for a first ink in a first relative position. Furthermore, preliminary ejection is performed for a second ink, which is different from the first ink, in a second relative position, which is different from the first relative position.

Specifically, in the present embodiment, the black ink (second ink) that may easily thicken is preliminarily ejected to an area on the cap member 10*a* where the preliminarily ejected color ink (first ink) that may not easily thicken has landed. By the ejection of the ink that may easily thicken near the ink that may not easily thicken or into the same position, thickening can be prevented and reduced with interaction between components. Accordingly, it is possible to suppress accumulation of the black ink that may easily thicken on the cap member 10*a* and to appropriately perform a discharging process of the preliminarily ejected ink.

Figure 9A:
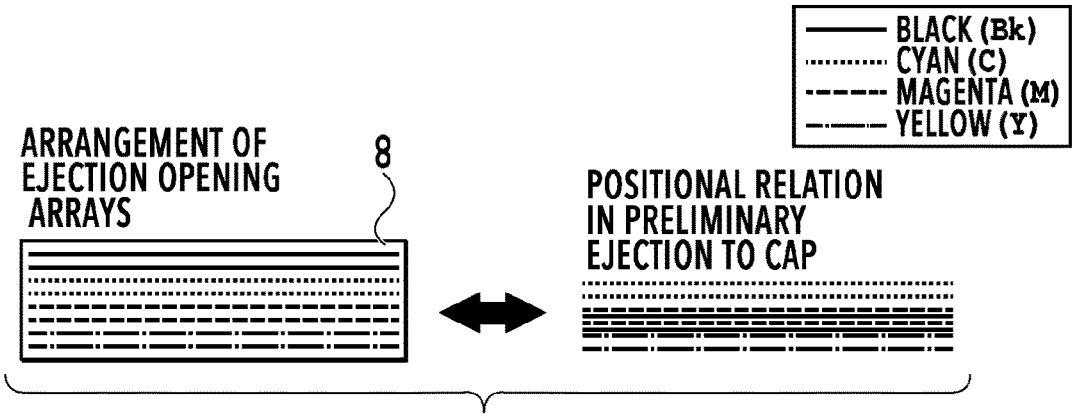
FIGS. 9A to 9D are diagrams illustrating a preliminary ejecting operation.

FIGS. 9A to 9D illustrate the preliminary ejecting operation in the present embodiment. FIG. 9A is a diagram schematically showing the arrangement of ejection opening arrays on the ejection opening surface 8*a* of the print head 8 and the positional relation between the preliminarily ejected inks landing on the cap member 10*a*. As shown in FIG. 9A, the preliminary ejection of the black ink to the cap member 10*a* is performed with respect to the area where the preliminarily ejected color ink has landed.

Figure 9B:
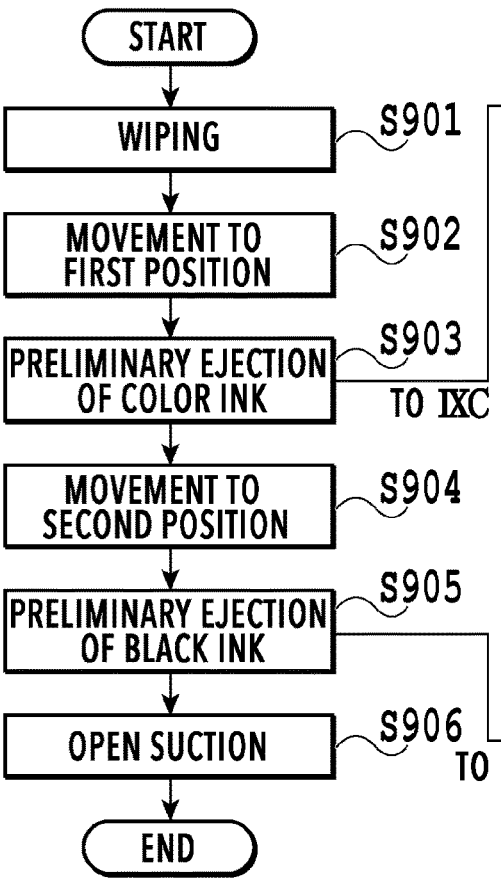
Figure 9C:
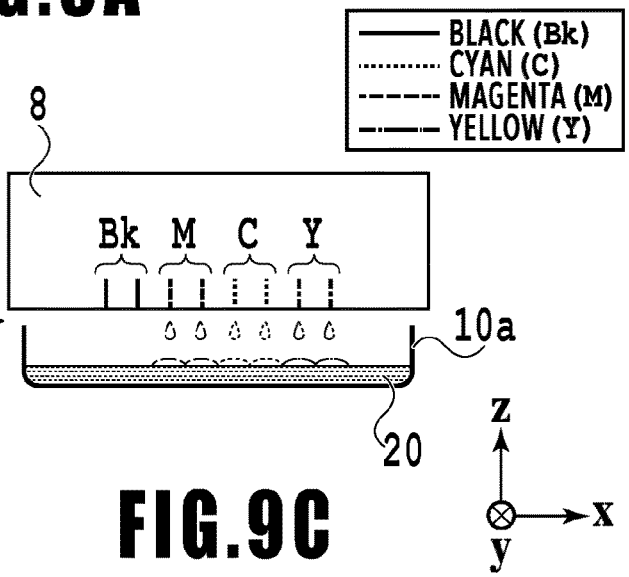
Figure 9D:
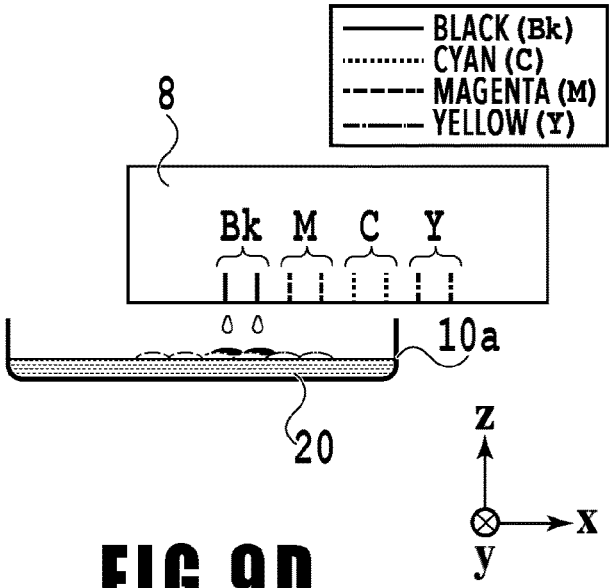

FIG. 9B is a diagram showing an example of a wiping sequence with the preliminary ejecting operation of the present embodiment. FIGS. 9C and 9D are diagrams schematically showing cross sections of the print head 8 and the cap member 10*a* in a predetermined position in a longitudinal direction (y-direction). The wiping sequence shown in FIG. 9B is executed by the print controller 202 in a case where print operation is performed on a predetermined number of print media S, for example, or based on a user instruction.

In step S901, the print controller 202 causes the maintenance control unit 210 to execute a wiping process. That is, the print controller 202 causes the maintenance control unit 210 to execute the above-described first wiping process or second wiping process. The printing apparatus 1 enters a maintenance state as shown in FIG. 7, and the wiping process is performed.

In step S902, the print controller 202 controls the print head 8 and the cap unit 10 to move to a first relative position (first position). More specifically, the print controller 202 controls the position of the print head 8 by using the head carriage control unit 208 and the position of the cap unit 10 by using the maintenance control unit 210. At this time, the printing apparatus 1 enters a standby state as shown in FIG. 1. The first position may be any position as long as preliminarily ejected color ink can land on the cap member 10*a*.

In step S903, the print controller 202 performs preliminary ejection of color ink. More specifically, the print controller 202 performs preliminary ejection of inks such as cyan, magenta, and yellow from their respective ejection openings in predetermined amounts. FIG. 9C is a cross-sectional diagram showing a situation in which preliminary ejection of color ink is performed in step S903. The preliminarily ejected ink is absorbed by an absorber 20 in the cap member 10*a*. Note that a location where ink lands by the preliminary ejection is referred to as a "position," and a location of ink that has already landed on the cap member 10*a* is referred to as an "area." This is because ink that has landed may spread across the absorber 20 and form an area.

After the end of the preliminary ejecting operation of color ink, the print controller 202 controls the print head 8 and the cap unit 10 to move to a second relative position (second position) in step S904. More specifically, the print controller 202 controls movement of the print head 8 and the cap unit 10 such that the relative position between the print head 8 and the cap unit 10 becomes a second relative position, which is different from the first relative position. The second relative position (second position) is a relative position in which the area on the cap member 10*a* where the color ink preliminarily ejected in the first relative position has landed faces the ejection opening array of the black ink. The second relative position (second position) includes not only a case where the position where the black ink lands on the cap member 10*a* matches the position where the color ink has landed, but also a case where the area where the color ink has landed faces the ejection opening array of the black ink.

It should be noted that change from the first relative position to the second relative position may be controlled in various aspects. For instance, the print controller 202 may control the position of the print head 8 by using the head carriage control unit 208 so that the print head 8 moves to the second relative position. The print controller 202 may also control the position of the cap unit 10 by using the maintenance control unit 210 so that the cap unit 10 moves to the second relative position. Alternatively, the print controller 202 may control change of the position of the print head 8 and may control change of the position of the cap unit 10 so that they both move to the second relative position. That is, to change the relative position between the print head 8 and the cap unit 10 from the first relative position to the second relative position, at least one of the print head 8 and the cap unit 10 is controlled to move, thereby changing the relative position. To control relative movement, various aspects as described above can be employed. In embodiments as will be described in the specification, the case of moving the cap unit 10 will be described by way of example.

It should be noted that regarding change from the first relative position to the second relative position, the change may be controlled by using various positioning members or regulating members for regulating a movement amount. Alternatively, the change may be controlled by storing a movement amount of a drive mechanism (not shown) for change to each relative position in the RAM 204 to control the movement amount based on a stored value. Any other system may be employed to control the change.

In a case where the relative position between the print head 8 and the cap unit 10 is changed to the second relative position, the print controller 202 performs preliminary ejection of the black ink in step S905. FIG. 9D is a cross-sectional diagram showing a situation in which preliminary ejection of black ink is performed in step S905. As shown in FIG. 9D, the black ink that may easily thicken is preliminarily ejected to a position overlapping with the area on the cap member 10*a* where the color ink, which may not easily thicken and was preliminarily ejected in advance, has landed. Accordingly, it is possible to reduce a thickening level of the black ink on the cap member 10*a*.

After the preliminary ejection of the black ink is performed, the print controller 202 performs open suction in step S906. The open suction is suction of ink in a state where the cap member 10*a* is in communication with atmosphere. Through the open suction, ink landed on the absorber 20 of the cap member 10*a* is sucked and discharged from the cap member 10*a*. Incidentally, although not shown in FIGS. 9B and 9C, the cap member 10*a* is provided with a suction hole. Performing open suction allows the ink landed on the absorber 20 to be discharged outside the cap member 10*a* through the suction hole.

As described above, the print head 8 and the cap unit 10 after the preliminary ejection are positioned in the standby state as shown in FIG. 1. It should be noted that the relative position between the print head 8 and the cap unit 10 in the standby state shown in FIG. 1 may be the first relative position or the second relative position.

As described above, according to the present embodiment, the preliminary ejection of the black ink that may easily thicken is performed with respect to the area on the cap member 10*a* where the color ink, which may not easily thicken and was preliminarily ejected in advance, has landed. That is, within the area where the color ink that may not easily thicken has landed, the black ink that may easily thicken will land. Therefore, it is possible to reduce a thickening level of the black ink and to suppress accumulation of the black ink that may easily thicken on the cap member 10*a*.

It should be noted that in the present embodiment, description has been given of the black ink as the example of ink that may easily thicken and the color ink such as cyan, magenta, and yellow as the example of ink that may not easily thicken. However, the present embodiment is not limited to them. The present embodiment may employ any aspect as long as a print head has ejection opening arrays capable of ejecting two or more types of inks to a print medium. That is, the print head may use two or more types of inks including a first ink and a second ink, where the second ink may relatively easily accumulate on a cap member compared to the first ink.

Furthermore, description has been given of the print head 8 of the present embodiment with an example of using a circulation type ink supply system. However, the present embodiment is not limit to this example. The present embodiment may also be applied to a print head using an ink supply system that is not of a circulation type. It should be noted that in the following embodiments, a different type of print head and ejection opening surface may be used, but for convenience in understanding, they will be described with the same reference numerals.

Second Embodiment

In the first embodiment, description has been given of the aspect of preliminary ejection of the black ink with respect to the area on the cap member 10*a* where the color ink preliminarily ejected in advance has landed. In the present embodiment, description will be given of an aspect of performing further preliminary ejection of color ink with respect to an area where the preliminarily ejected black ink has landed. More specifically, description will be given of an aspect that color ink preliminarily ejected at timings before and after preliminary ejection of the black ink sandwiches preliminarily ejected black ink. This aspect is preferable in a case where a viscosity at the time of evaporation of water content in black ink is higher than that in color ink, for example.

Figure 10A:
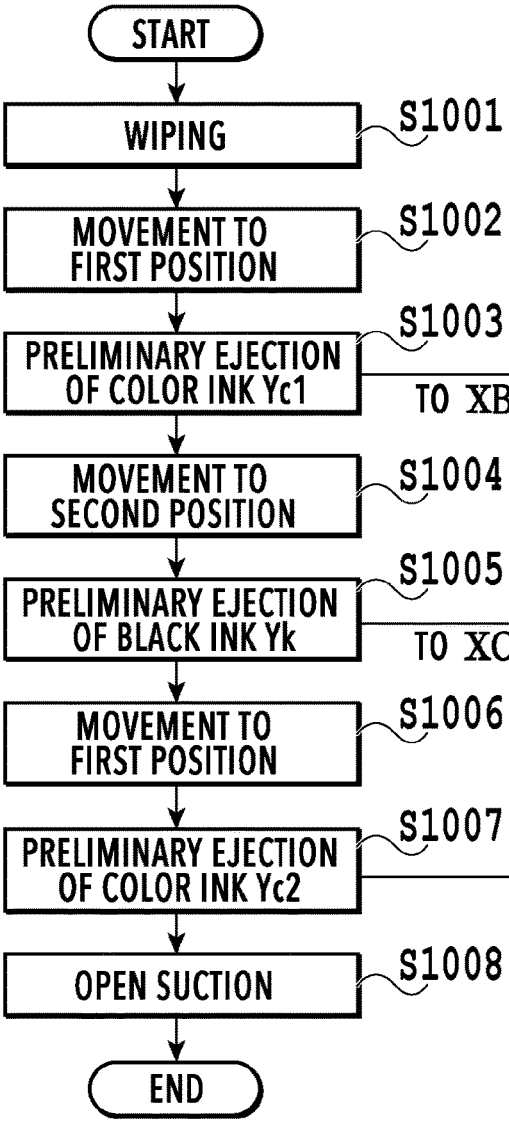
FIGS. 10A to 10D are a flowchart and cross-sectional diagrams.

FIGS. 10A to 10D are a flowchart and diagrams showing cross sections of a situation in preliminary ejection performed according to the present embodiment. FIG. 10A is a flowchart of the present embodiment. In step S1001 to step S1005, the same process as that from step S901 to step S905 of FIG. 9B is performed, and thus description will be omitted.

In step S1006, the print controller 202 controls the cap unit 10 to move to a first relative position (first position). That is, the print controller 202 controls the cap unit 10 to move to the same first relative position as in step S1002. Then in step S1007, the print controller 202 performs preliminary ejection of color ink. The process of open suction in step S1008 is the same as the process in step S906 of FIG. 9B.

Figure 10B:
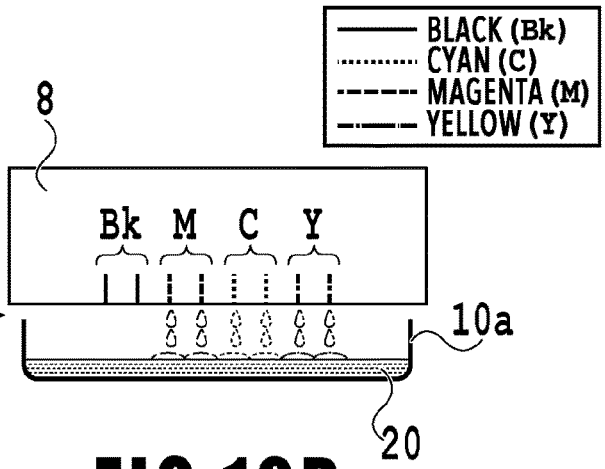
Figure 10C:
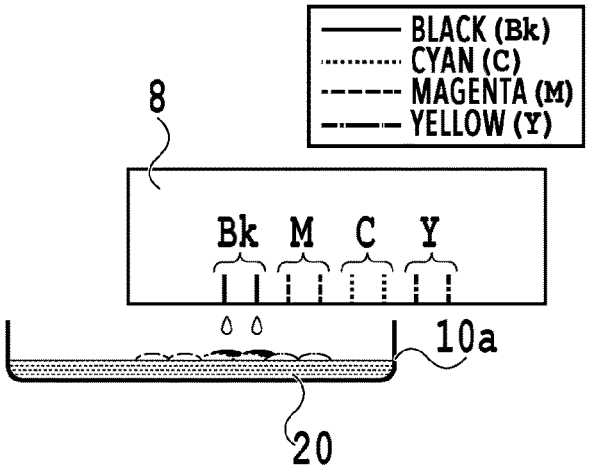
Figure 10D:
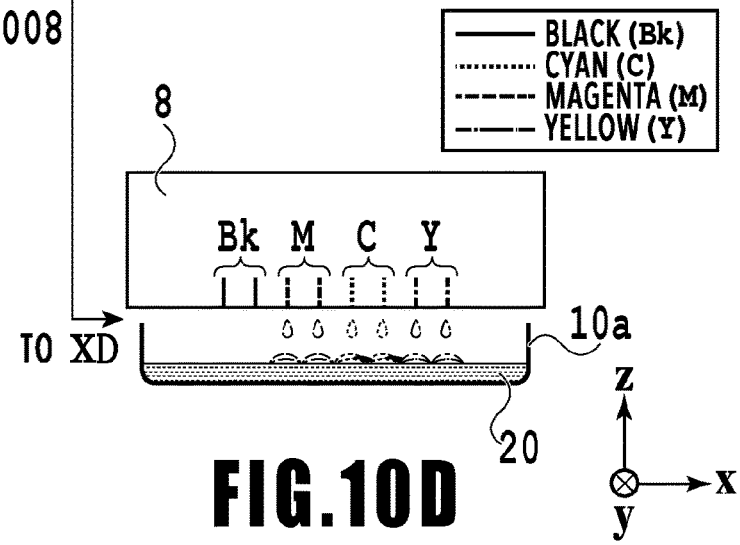

In the present embodiment, as shown in FIGS. 10B to 10D, regarding the preliminary ejection of color ink, an ejection amount in a preceding first preliminary ejecting operation (S1003) is different from an ejection amount in a following second preliminary ejecting operation (S1007). If a preliminary ejection amount Yc1 in the first preliminary ejecting operation (S1003) is compared to a preliminary ejection amount Yc2 in the second preliminary ejecting operation (S1007), Yc1 is equal to or greater than Yc2, where Yc1 and Yc2 each represent a preliminary ejection amount per ink for color ink. More specifically, a preliminary ejection amount in the first preliminary ejecting operation is set to be greater than a preliminary ejection amount in the second preliminary ejecting operation. This increases an effect of preventing thickening of black ink. Furthermore, a total of preliminary ejection amounts (Yc1+Yc2) of preliminary ejection of color ink is equal to or greater than an ejection amount Yk of preliminary ejection of black ink. More specifically, a preliminary ejection amount of black ink is less than a total of an amount of color ink in the first preliminary ejecting operation and an amount of color ink in the second preliminary ejecting operation. Based on the experiment result, performing preliminary ejection in such a relation between ejection amounts allows reduction of ink thickening.

It should be noted that in the present embodiment, description has been given of the example of the aspect that the cap unit 10 moves to the first relative position (first position) again in step S1006. However, the present embodiment is not limited to this. In step S1006, the cap unit 10 may be controlled to move to a third relative position, which is different from the first relative position. In this example, the third relative position may be a position where preliminary ejection of color ink is performed with respect to the area where the black ink preliminarily ejected in the second relative position has landed.

Third Embodiment

In the first and second embodiments, description has been given of the examples of the aspects that any ink supply system can be applied. In the present embodiment, description will be given of an aspect that a print head 8 using an ink supply system of a circulation system performs a maintenance process to which circulation is further combined.

In the first and second embodiments, arrangement areas where ejection opening arrays extend on the ejection opening surface 8*a* are substantially identical in the direction (i.e., y-direction) perpendicular to the direction in which a print medium S is conveyed. However, in a case where ejection opening arrays are displaced in the y-direction, even if the relative position between the print head 8 and the cap unit 10 is changed in a conveying direction (x-direction), landing positions of preliminarily ejected inks may not overlap each other. In the present embodiment, such a case is controlled where even if the print head 8 and the cap unit 10 are relatively moved in one direction on a plane that is substantially parallel with the ejection opening surface, landing positions of black ink and landing positions of color ink do not overlap each other. It should be noted that the length of ejection opening arrays of black ink and the length of ejection opening arrays of color ink are the same.

Figure 11A:
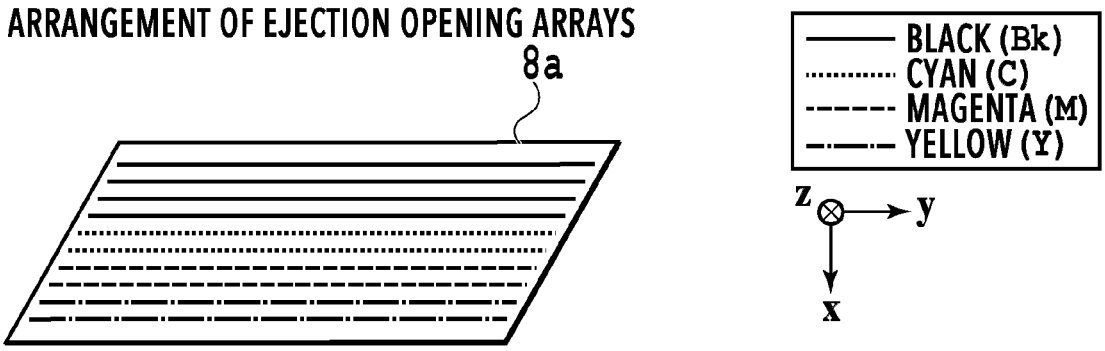
FIGS. 11A to 11D are diagrams showing an ejection opening surface and a positional relation in preliminary ejection.
Figure 11B:
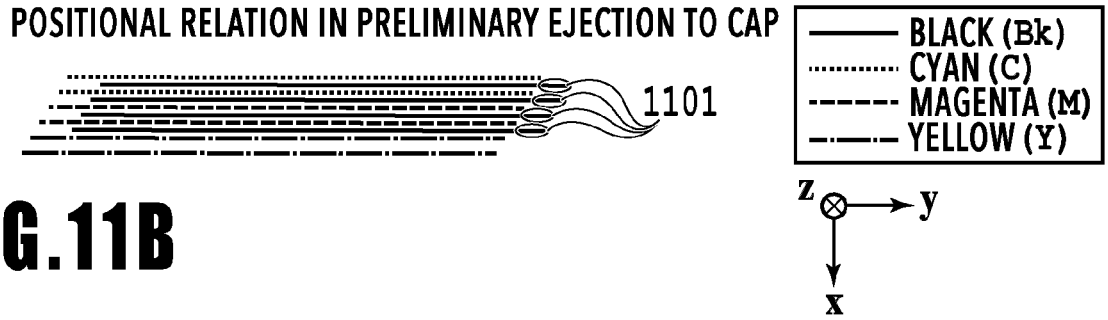

FIG. 11A shows an example of an ejection opening surface 8*a* in the present embodiment and FIG. 11B shows a positional relation of landing on the cap member 10*a* between inks which are preliminarily ejected from the ejection opening arrays shown in FIG. 11A. Unlike the first and second embodiments, in the present embodiment, as shown in FIG. 11A, areas where ejection opening arrays extend on the ejection opening surface 8*a* in the y-direction (a width direction of a print medium S) are displaced by one column in the x-direction relative to a predetermined reference position in the y-direction (a width direction of a print medium S). In the present embodiment, a print head is used which has arrangement areas, where ejection opening arrays extend on the ejection opening surface 8*a*, align in the x-direction with displacement (with a predetermined amount of offset) corresponding to a predetermined distance relative to a predetermined reference position in the y-direction.

In a case where change in the relative position is limited to a predetermined direction, with use of the print head having the ejection opening arrays arranged with displacement corresponding to a predetermined distance in the y-direction, there may be an ejection opening of black ink from which preliminary ejected ink does not land. For example, as shown in FIG. 11B, there may be an ejection opening of black ink from which preliminary ejected ink does not land within an area where preliminary ejected color ink has landed. An area 1101 of FIG. 11B shows black ink that does not land within the area where preliminary ejected color ink has landed in a preliminary ejecting operation of black ink. Hereinafter, ejection openings from which preliminary ejected black ink does not land within the area where color ink has landed are referred to as "ejection openings outside the overlapping area." Since preliminary ejected black ink (black ink ejected to the area 1101) from the ejection openings outside the overlapping area does not land in a landing area of color ink, the black ink may accumulate on the cap member 10*a*.

Accordingly, in the present embodiment, control is made not to perform preliminary ejection for the ejection openings outside the overlapping area. Since preliminary ejection is not performed, it is possible to prevent accumulation of ink on the cap member 10*a* due to the ejection openings outside the overlapping area. Without the preliminary ejection, however, color mixing and thickening of ink may occur in the ejection opening as described above. In the present embodiment therefore, ink circulation is performed so as to distribute mixed color ink and thickened ink in the ejection openings outside the overlapping area to an ink flow path. This allows reduction of poor images due to color mixing of ink and reduction of failures in ejection due to ink thickening.

It should be noted that in the process of the present embodiment, color mixed ink in a very few ejection openings (ejection openings outside the overlapping area) for which preliminary ejection is not performed enters the ink flow path of black ink. However, the black ink has a low lightness, and thus an influence of the mixed color ink entering the flow path on an image can be ignored.

Figure 11C:
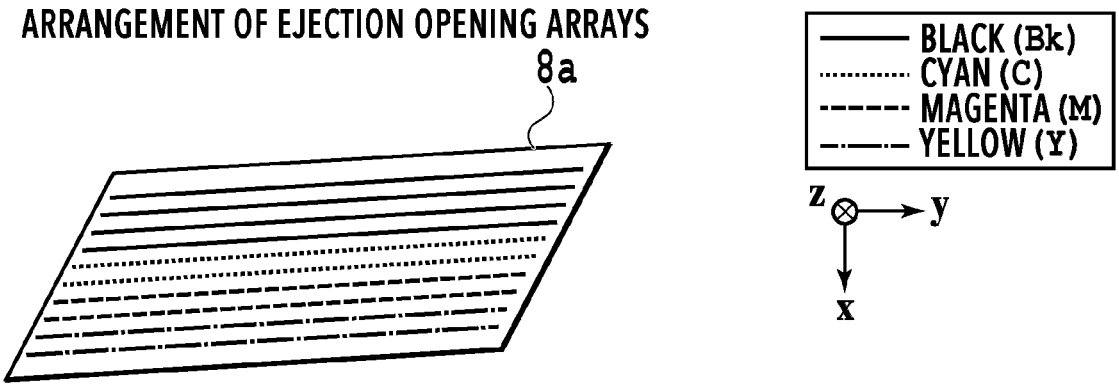
Figure 11D:
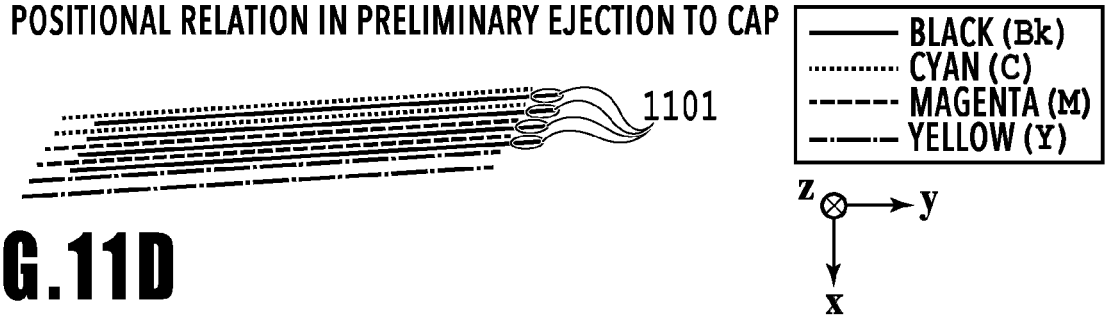

FIG. 11C is a modification example of the arrangement of ejection opening arrays and FIG. 11C shows an ejection opening surface 8*a* of the modification example. FIG. 11D shows a positional relation of landing on the cap member 10*a* between inks which are preliminarily ejected from the ejection opening arrays shown in FIG. 11C. In FIG. 11A, the ejection opening arrays are arranged substantially in parallel with the y-direction, whereas in FIG. 11C, the ejection opening arrays are arranged with a predetermined inclination with respect to the y-direction. Furthermore, the ejection opening arrays are substantially parallel with each other and are arranged with a predetermined amount of offset in the y-direction. Also in the modification example, as shown in the area 1101, there are ejection openings outside the overlapping area, from which black ink that does not land within the area of preliminarily ejected color ink is ejected. Accordingly, ink circulation is performed instead of preliminary ejection for the ejection openings outside the overlapping area, thereby reducing failures in ejection.

Hereinafter, a flow of the process of the present embodiment will be described after explaining a circulation system employed in the present embodiment.

<Description of Ink Circulation System>

Figure 12:
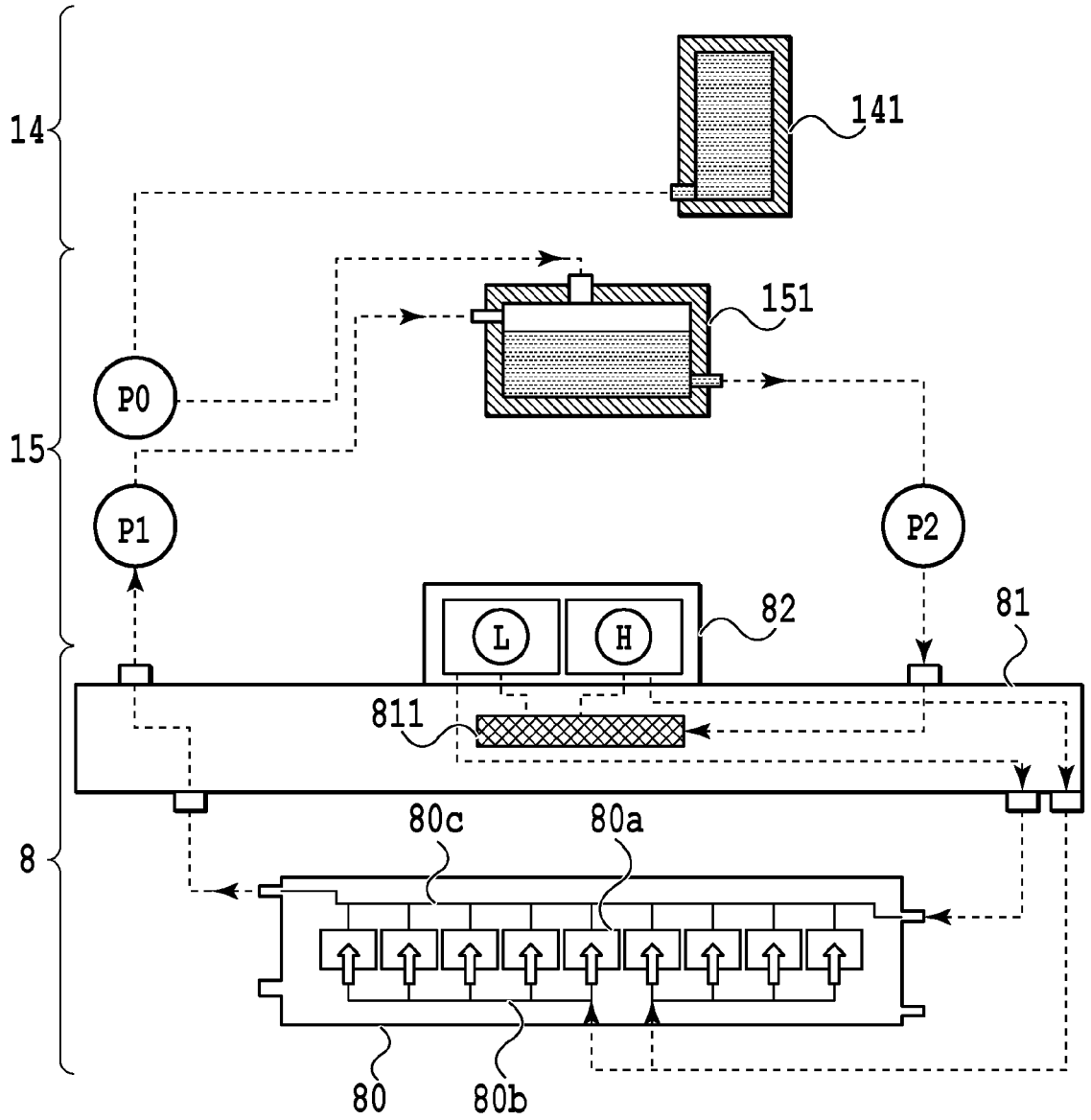
FIG. 12 is a diagram showing a circulation type ink supply system.

FIG. 12 is a diagram showing a circulation type ink supply system used in the inkjet printing apparatus 1 according to the present embodiment. The circulation type ink supply system is made up of an ink tank unit 14, an ink supply unit 15, and a print head 8 which are connected to each other. In this example, a circulation system is shown for one color of ink, but the circulation system is prepared for each ink color in actuality.

The ink tank unit 14 is provided with a main tank 141 for reserving a relatively large amount of ink. The ink supply unit 15 includes a buffer tank 151 and three pumps P0, P1, and P2 which are connected to the buffer tank 151. Circulation pumps P1 and P2 cause ink in the entire circulation path to flow so that the ink in the supply system moves from the circulation pump P1 toward the circulation pump P2 through the buffer tank 151. A fill-in pump P0 is activated in a case where a small amount of ink remains in the buffer tank 151 so as to fill the buffer tank 151 with new ink supplied from the main tank 141.

The print head 8 has an ink ejection unit 80, a circulation unit 81, and a negative pressure control unit 82. The ink ejection unit 80 has a structure for ejecting ink droplets based on ejection data. The present embodiment employs a system that a heater is provided for each printing element and a voltage is applied across the heater to generate film boiling in ink, thereby ejecting the ink from ejection openings by a growing energy of bubbles. The negative pressure control unit 82 adjusts a pressure of ink so that the ink flows under an appropriate pressure in a normal direction in the ink ejection unit 80. The circulation unit 81 controls supply and collection of ink among the buffer tank 151, the negative pressure control unit 82, and the ink ejection unit 80.

The ink supplied from the buffer tank 151 to the circulation unit 81 is supplied to the negative pressure control unit 82 through a filter 811. In the negative pressure control unit 82, there are provided a negative pressure control unit H for causing ink to flow under a relatively high pressure and a negative pressure control unit L for causing ink to flow under a relatively low pressure. The ink flowing out of the negative pressure control unit H and the ink flowing out of the negative pressure control unit L are individually supplied to the ink ejection unit 80 via the circulation unit 81 through their respective paths.

The ink ejection unit 80 has a plurality of printing element substrates 80*a* arranged in the y-direction, each printing element substrate 80*a* having a plurality of nozzles arrayed in the y-direction to form elongate nozzle arrays. The ink ejection unit 80 also has a common supply flow path 80*b* for leading ink supplied under a relatively high pressure by the negative pressure control unit H and a common collection flow path 80*c* for leading ink supplied under a relatively low pressure by the negative pressure control unit L. Furthermore, each printing element substrate 80*a* has an individual flow path connecting to the common supply flow path 80*b* and an individual flow path connecting to the common collection flow path 80*c*. Therefore, in each printing element substrate 80*a*, there is a flow of ink from the common supply flow path 80*b* having a relatively high pressure into the common collection flow path 80*c* having a relatively low pressure. Then, if an ejecting operation is performed on the printing element substrate 80*a*, part of circulating ink is discharged by being ejected, but the rest of the ink flows back to the circulation unit 81 through the common collection flow path 80*c* and goes back to the buffer tank 151 through the circulation pump P1.

In this circulation type ink supply system, since heat generated by the ejecting operation of the printing element substrate 80*a* is lost by the circulating ink, even if the ejecting operation is continuously performed, failures in ejection caused by heat storage can be suppressed. Furthermore, since the circulation type ink supply system has a configuration of suppressing stagnation of bubbles generated by the ejecting operation, thickened ink, foreign matter, and the like, it is possible to maintain a favorable ejection state of all nozzles.

In particular, since bubbles generated by the ejecting operation tend to move upward, performing print operation in a state where the ejection opening surface 8*a*, namely, the ink ejection unit 80, is inclined like the present embodiment, may cause the bubbles to stagnate in a particular printing element substrate 80*a* or a particular ejection opening. However, using the circulation type ink supply system allows the generated bubbles to be reliably collected through the common collection flow path 80*c*, and therefore, flexibility of the direction of the print head 8 during the ejecting operation increases. As a result, the printing position as shown in FIG. 3 becomes available, which allows downsizing of the apparatus.

Meanwhile, in the maintenance position, it is desired that the ejection opening surface 8*a* be horizontal so as to have an influence of gravity equally on each printing element substrate 80*a* and each ejection opening. Therefore, the print head 8 needs to appropriately move among the standby position shown in FIG. 1, the printing position shown in FIG. 3, and the maintenance position shown in FIG. 7, and there is a need for a configuration that allows the print head 8 to simply move in a short period of time.

<Flowchart>

Figure 13:
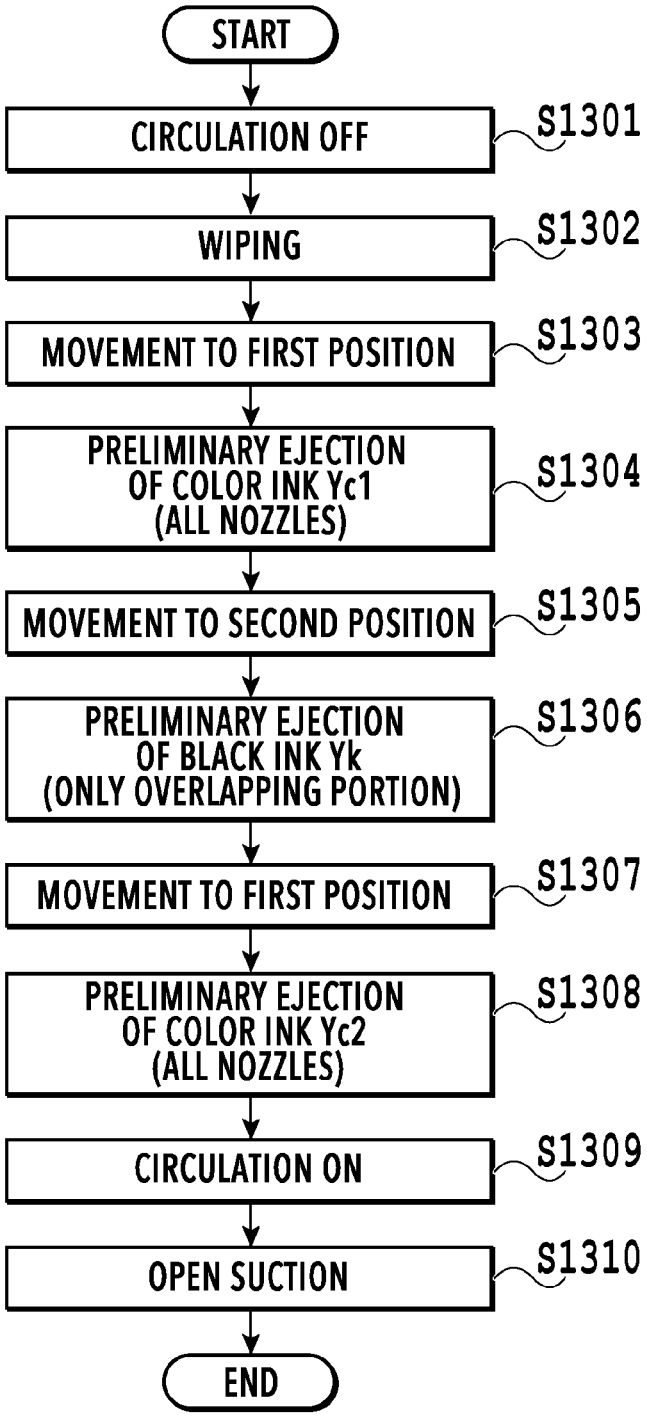
FIG. 13 is a flowchart.

FIG. 13 is a flowchart of the present embodiment. Hereinafter, a process in the wiping sequence will be described like the above-described embodiments. It should be noted that the ink supply system employs a circulation type system, and description will be given on an assumption that the above-described circulation process has already been working.

In step S1301, the print controller 202 controls an ink supply control unit 209 to suspend circulation in the ink supply system. In the following steps, a wiping process is performed. If wiping is performed with the circulation continued, the wiping causes ink of another color forced into the ejection opening to enter the ink flow path during the wiping operation. Therefore, the ink circulation is suspended before the wiping process is performed.

In step S1302 to step S1305, the same process as that from step S1001 to step S1004 of FIG. 10A is performed, and thus description will be omitted.

In step S1306, the print controller 202 performs preliminary ejection of black ink. In this step S1306, preliminary ejection of black ink is not performed from all of the ejection openings. Preliminary ejection is performed in a second relative position (second position) by using only ejection openings of black ink from which ink can land with respect to an area on the cap member 10*a* where color ink preliminarily ejected in advance has landed. In other words, control is made not to perform preliminary ejection for the ejection openings outside the overlapping area.

It should be noted that the ejection openings outside the overlapping area are specified beforehand based on the area where change in a relative position is controllable and the arrangement of ejection openings. A ROM 203 and a RAM 204 store therein information identifying the ejection openings outside the overlapping area. The print controller 202 refers to the stored information and identifies, for black ink, the ejection openings for which preliminary ejection is performed and the ejection openings for which preliminary ejection is not performed. Typically, as shown in FIG. 11B, preliminary ejection of black ink is performed by using ejection openings other than the ejection openings located at the end of the ejection opening array of black ink. Furthermore, the ejection openings outside the overlapping area do not need to be exactly distinguished from the ejection openings inside the overlapping area. As for the ejection openings inside the overlapping area adjacent to the ejection openings outside the overlapping area, preliminary ejection may be performed with respect to an area where color ink has landed. However, in consideration of tolerances at the time of movement control and the like, control may be made not to perform preliminary ejection for part of the ejection openings inside the overlapping area as well.

The following step S1307 and step S1308 are the same as step S1006 and step S1007 of FIG. 10A.

In step S1309, the print controller 202 controls the ink supply control unit 209 to start the ink circulation, which has been suspended. By the start of the ink circulation, a very small amount of mixed color ink that may be adhering to the ejection openings of black ink for which preliminary ejection has not been performed may enter the flow path of black ink. In step S1310, open suction is performed and the process comes to an end.

It should be noted that in the present embodiment, like the second embodiment, by way of example, the aspect that preliminarily ejected black ink is sandwiched between color ink that is preliminarily ejected at timings before and after the preliminary ejection of the black ink has been described. However, the present embodiment is not limited to this. As described in the first embodiment, preliminary ejection of black ink may be performed with respect to the area where preliminarily ejected color ink has landed.

In the present embodiment, even in a case where there are ejection openings of black ink that cannot land in a manner overlapping with the landing area of color ink on the cap member 10*a*, it is possible to suppress accumulation of ink on the cap member 10*a* and to perform preferable maintenance of the ejection opening surface 8*a*.

Fourth Embodiment

In the third embodiment, by way of example, the aspect that preliminary ejection is performed by using ejection openings other than the ejection openings located at the end of the ejection opening array of black ink has been described. In the present embodiment, description will be given of an aspect that preliminary ejection is performed by using ejection openings in a portion that may more reliably have a resolution effect among the ejection openings of black ink. More specifically, description will be given of an aspect that preliminary ejection of black ink is performed by using only ejection openings capable of ejecting ink to a center part of the area where preliminarily ejected color ink has landed. That is, regarding black ink, description will be given of an aspect that preliminary ejection is performed by using only the ejection openings located near the center of the ejection opening arrays. It should be noted that the ejection openings located near the center of the ejection opening arrays may be ejection openings other than the ejection openings located at both ends, for example. One of the ends may include the ejection openings outside the overlapping area described in the third embodiment.

Figure 14A:
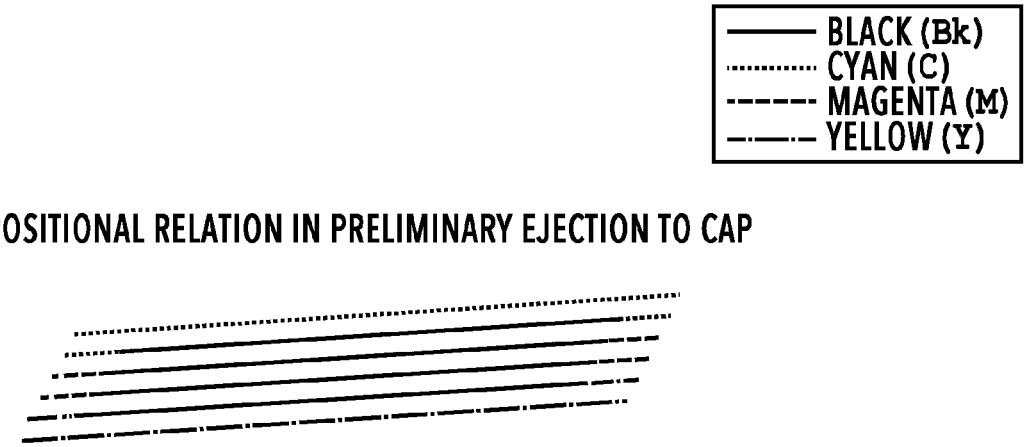
FIGS. 14A and 14B are diagrams showing preliminarily ejected inks.
Figure 14B:
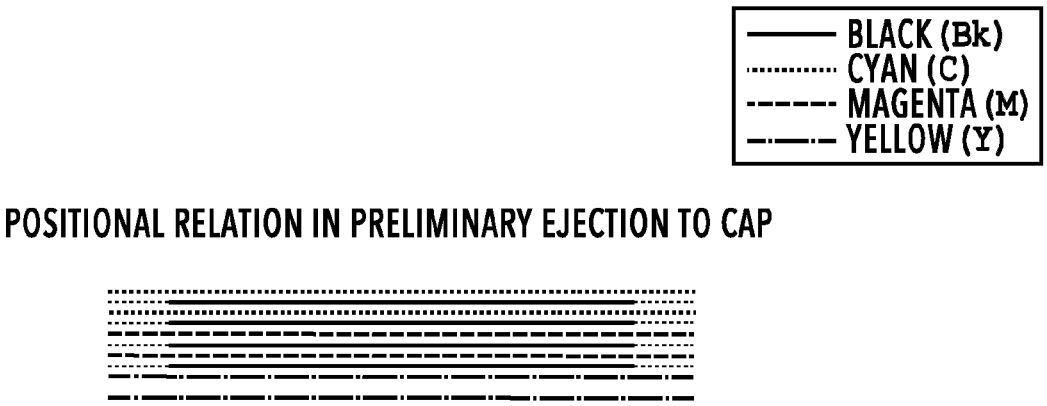

FIGS. 14A and 14B are diagrams schematically showing positions in which preliminarily ejected inks land on the cap member 10*a* in the present embodiment. FIG. 14A is a diagram assuming the case of using an ejection opening surface 8*a* having the same arrangement of the ejection opening arrays shown in FIG. 11A. In the present embodiment, preliminary ejection is performed by using ejection openings capable of ejecting black ink to the center part of the area where preliminarily ejected color ink has landed. According to this aspect, since preliminary ejection is performed by using ejection openings in an overlapping center portion having a high resolution effect, accumulation of black ink may further be suppressed. Furthermore, as described in the third embodiment, regarding the ejection openings of black ink for which preliminary ejection is not performed, color mixed ink resulting from the circulation enters the ink flow path and is distributed. It should be noted that preliminary ejection by using the ejection openings only in the overlapping center portion, as shown in FIG. 14B, can also be applied to the print head 8 having ejection opening arrays extending in the y-direction described in the first and second embodiments.

Fifth Embodiment

In the present embodiment, description will be given of an aspect of using a print head 8 having an ejection opening surface 8*a* on which a plurality of ejection modules 1580 (printing element substrates) are arranged in the y-direction, each ejection module 1580 having ejection opening arrays extending in a direction with a predetermined angle with respect to the y-direction. More specifically, description will be given of an aspect of using a print head 8 having a plurality of ejection modules arranged in a second direction, each having ejection opening arrays extending in a direction with a predetermined angle with respect to the y-direction (second direction) perpendicular to the x-direction (first direction) in relative movement.

Figure 15A:
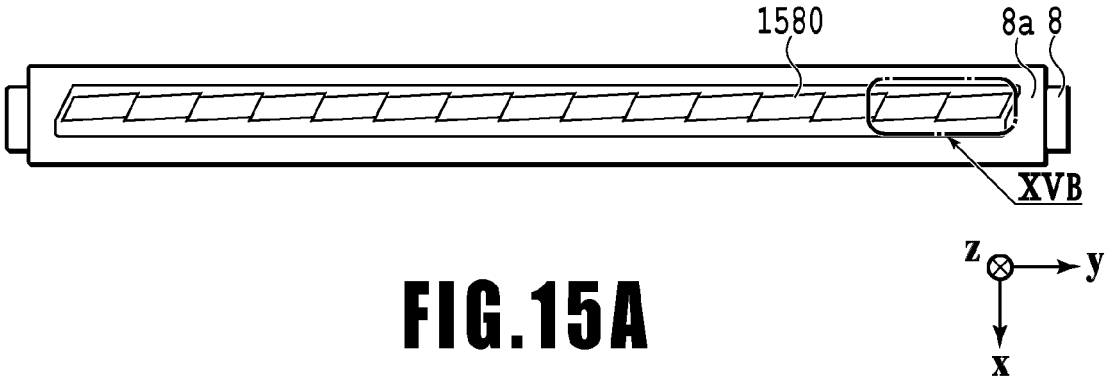
FIGS. 15A to 15E are diagrams showing an example of using a plurality of ejection modules.
Figure 15B:
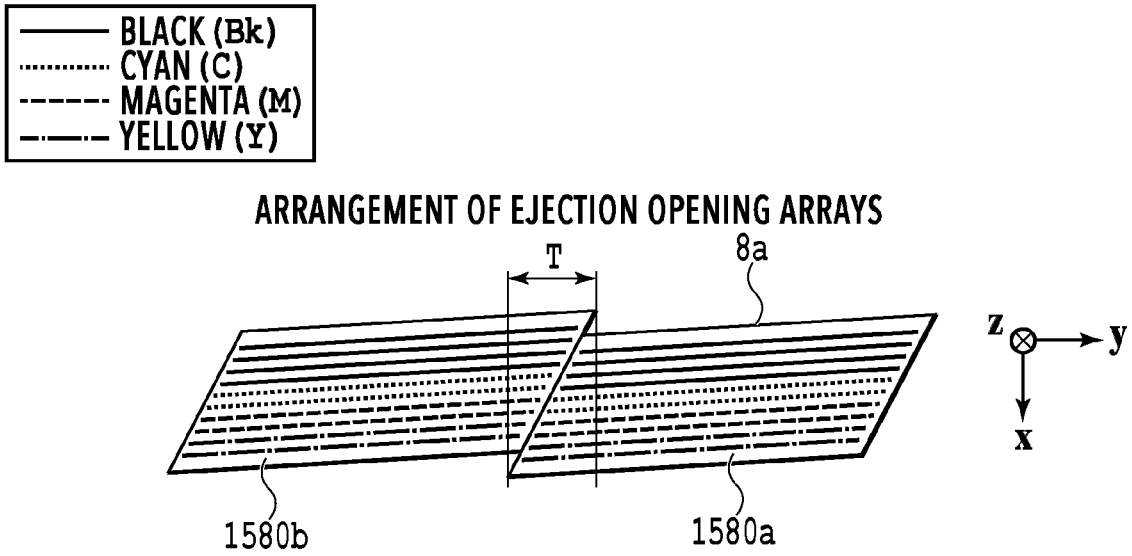

FIG. 15A is a diagram showing a bottom surface (ejection opening surface 8*a*) of the print head 8 of the present embodiment and FIG. 15B is an enlarged view of an area XVB, corresponding to two ejection modules arranged as shown in FIG. 11C. As shown in FIG. 15B, in a joint portion T of the ejection modules 1580, there is an area where ejection openings of an ejection module 1580*a* overlap with ejection openings of an adjacent ejection module 1580*b* in the y-direction. In a case where there are overlapping ejection openings in the y-direction in this joint portion T, ejection may be performed from either the ejection openings of the ejection module 1580*a* or the ejection openings of the ejection module 1580*b*. Accordingly, in a case where a print medium S is conveyed in the x-direction and print operation is performed, it is possible to make black streaks and unprinted portions in a printed image less visible.

Figure 15C:
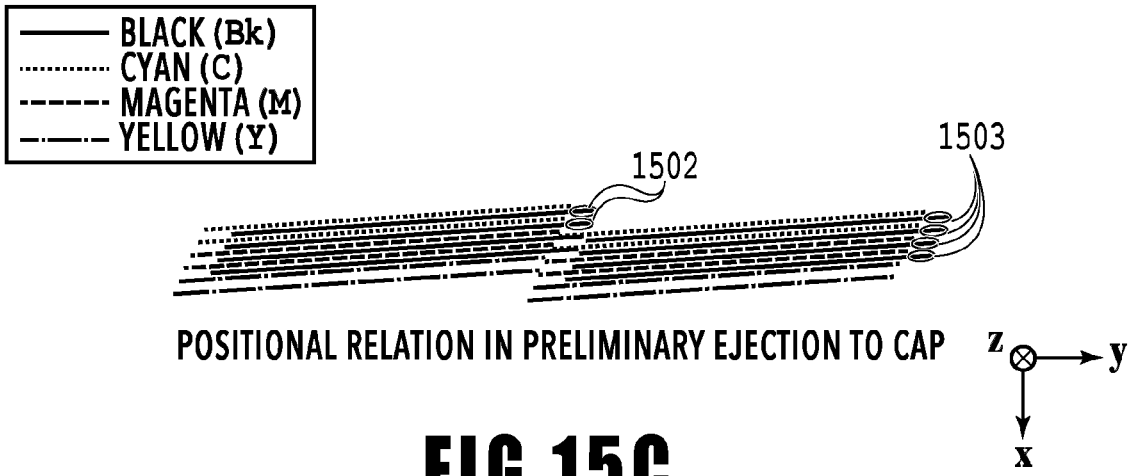

FIG. 15C is a diagram showing the positional relation between preliminarily ejected inks landing on the cap member 10*a* by using the ejection modules 1580 of FIG. 15B. In a case where color ink is preliminarily ejected in a first relative position and black ink is preliminarily ejected in a second relative position, in the joint portion T, there are ejection openings (see an area 1502) from which black ink does not land on the area where preliminarily ejected color ink has landed. Furthermore, like the example described in the third embodiment, the ejection module 1580*a* located at the end of the ejection module array in the y-direction includes ejection openings from which black ink does not land in positions where color ink has landed (see an area 1503). That is, as shown in the area 1503, regarding also the ejection openings located at the end of the ejection module array, there are ejection openings from which black ink does not land in the position where color ink has landed.

Accordingly, in the present embodiment, preliminary ejection of black ink is performed in a second relative position by using only the ejection openings from which preliminarily ejected ink can land with respect to the area where color ink preliminarily ejected in a first relative position has landed. Then, like the fourth embodiment, regarding thickened ink in the ejection openings of black ink for which preliminary ejection has not been performed, circulation is performed so that the thickened ink enters the ink flow path and is distributed.

Figure 15D:
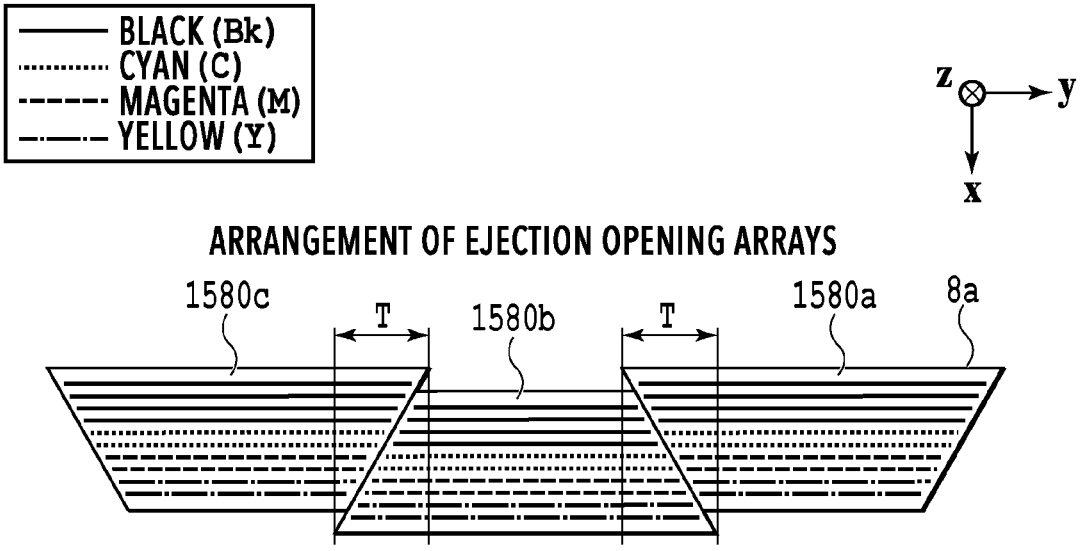
Figure 15E:
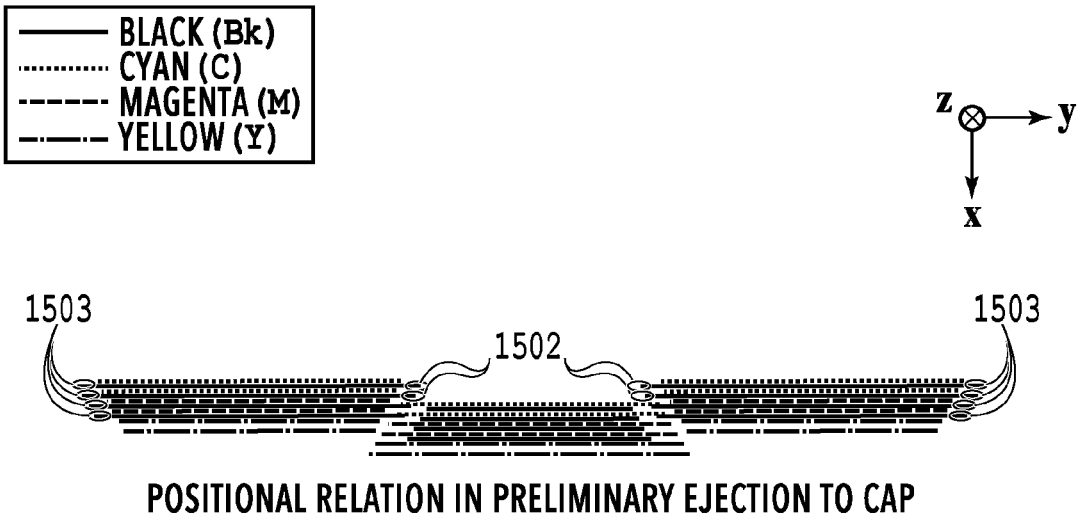

FIG. 15D shows a modification example of the ejection modules 1580. As shown in FIG. 15D, the ejection modules 1580 of the modification example are trapezoidal and have a plurality of ejection opening arrays that are substantially parallel with the top and bottom sides of the trapezoid. The ejection modules 1580*a* and 1580*c* are arranged in the same direction, whereas the ejection module 1580*b* therebetween is arranged such that the top and bottom sides are opposite to those of the ejection modules 1580*a* and 1580*c*. Since the plurality of ejection opening arrays provided on each ejection module 1580 have different lengths in the y-direction, part of the ejection openings of black ink in the joint portion T as shown in FIG. 15E do not serve as ejection openings from which black ink does not land on the area where color ink has landed (the area 1502). Furthermore, the ejection modules 1580*a* and 1580*c* located at the end of the ejection module array in the y-direction have an array of ejection openings outside the overlapping area, and there are ejection openings from which black ink does not land in positions where color ink has landed (see the area 1503).

As described above, in the present embodiment, in a case where change in a relative position is controlled, even if there are ejection openings from which black ink cannot land in a manner overlapping with the landing area of color ink, it is possible to suppress accumulation of ink on the cap member 10*a*.

Sixth Embodiment

In the above-described embodiments, black ink has been described as an example of the first ink that may easily accumulate, and color ink has been described as an example of the second ink that may not easily accumulate. Then, description has been given of the aspect of suppressing accumulation by performing preliminary ejection such that black ink overlaps with the area on the cap member 10*a* where preliminarily ejected color ink has landed.

Incidentally, there is a reaction liquid as a liquid that may not easily accumulate but facilitates accumulation of ink by being mixed with the ink. The reaction liquid is a liquid containing a component that reacts with ink and causes the ink to thicken (hereinafter referred to as an "ink thickening component"). As used herein, the term "ink thickening" represents a case where color material, resin, and the like constituting ink chemically react by coming into contact with the ink thickening component, or physically adsorb the ink thickening component, whereby a viscosity of the entire ink increases. Examples also include a case where part of an ink composition such as color material is condensed, whereby a viscosity of ink locally increases.

In the case of using the reaction liquid, unlike the above-described embodiments, it is preferable that the area on the cap member 10*a* where the preliminarily ejected reaction liquid lands be separated from the area on the cap member 10*a* where the preliminarily ejected ink lands. As described above, since the reaction liquid serves to thicken the ink, performing preliminary ejection such that the reaction liquid overlaps with the ink may facilitate the accumulation on the cap member 10*a*.

Figure 16B:
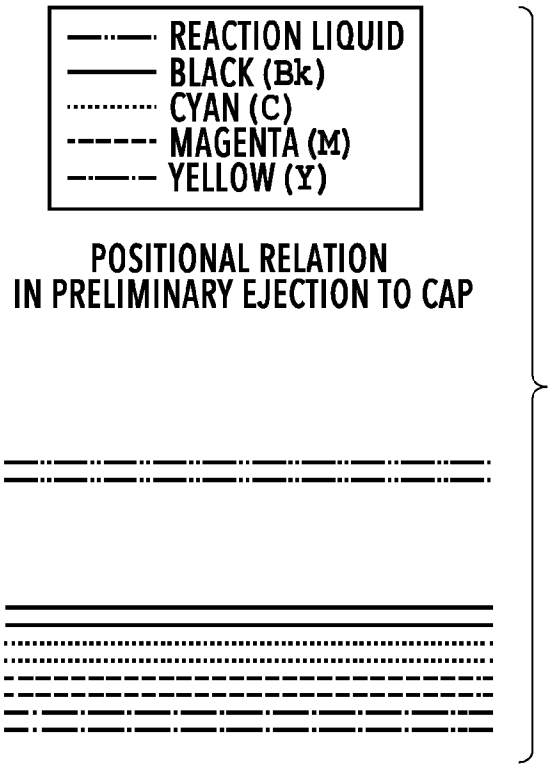
FIGS. 16A and 16B are diagrams showing an arrangement of ejection openings and a positional relation in preliminary ejection.
Figure 16A:
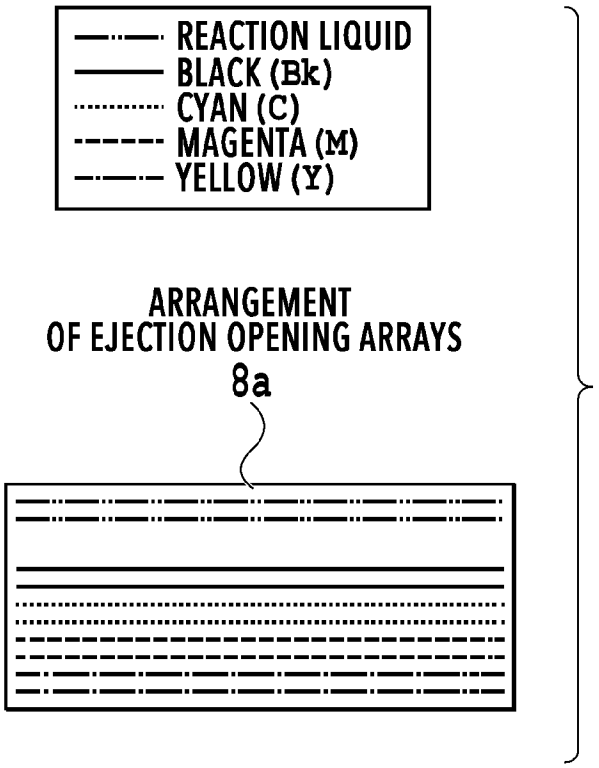

FIGS. 16A and 16B are diagrams showing the arrangement of ejection opening arrays and the positional relation between the preliminarily ejected inks landing on the cap member 10*a* according to the present embodiment. As shown in FIG. 16A, in the present embodiment, ejection opening arrays that eject the reaction liquid are additionally arranged on the ejection opening surface 8*a*. As shown in FIG. 16B, in the present embodiment, a distance between a position in which the preliminarily ejected reaction liquid lands and a position in which the preliminarily ejected ink lands is greater as compared to the arrangement of the ejection opening arrays. This can prevent the ink from reacting with the reaction liquid and accumulating on the cap member 10*a*. It should be noted that the type of reaction liquid is not limited to this, and ink containing color material and an ink thickening component may be used.

It should be noted that in this example, description has been given mainly of the landing positions of the reaction liquid and the ink in preliminary ejection. As described above in the embodiments, it is preferable that black ink be preliminarily ejected to the area where color ink has been preliminarily ejected. Therefore, the aspect of the present embodiment may be combined with the aspects of the above-described embodiments. For instance, preliminary ejection of color ink may be performed in a first relative position, preliminary ejection of black ink may be performed in a second relative position, and preliminary ejection of a reaction liquid may be performed in a third relative position.

Seventh Embodiment

In the above-described embodiments, description has been given of the example of the case where the direction in relative movement is only the x-direction. However, the direction allowing relative movement may include the x-direction and a direction different from the x-direction. For example, in addition to the x-direction, the y-direction crossing the x-direction may allow relative movement. In this manner, in a case where change in a relative position is controllable in two dimensions, there is basically no such problem that there is an area where black ink cannot be preliminarily ejected in a manner overlapping with the landing area of preliminarily ejected color ink as described in the third embodiment, for example. However, due to production tolerances or the like, there may be a case where black ink cannot still be preliminarily ejected in an overlapping manner. Accordingly, in the present embodiment, in consideration of a range of a maximum value of displacement of a position in which black ink can overlap, preliminary ejection of black ink is performed for the ejection openings excluding the area of this portion from the ends.

Figure 17B:
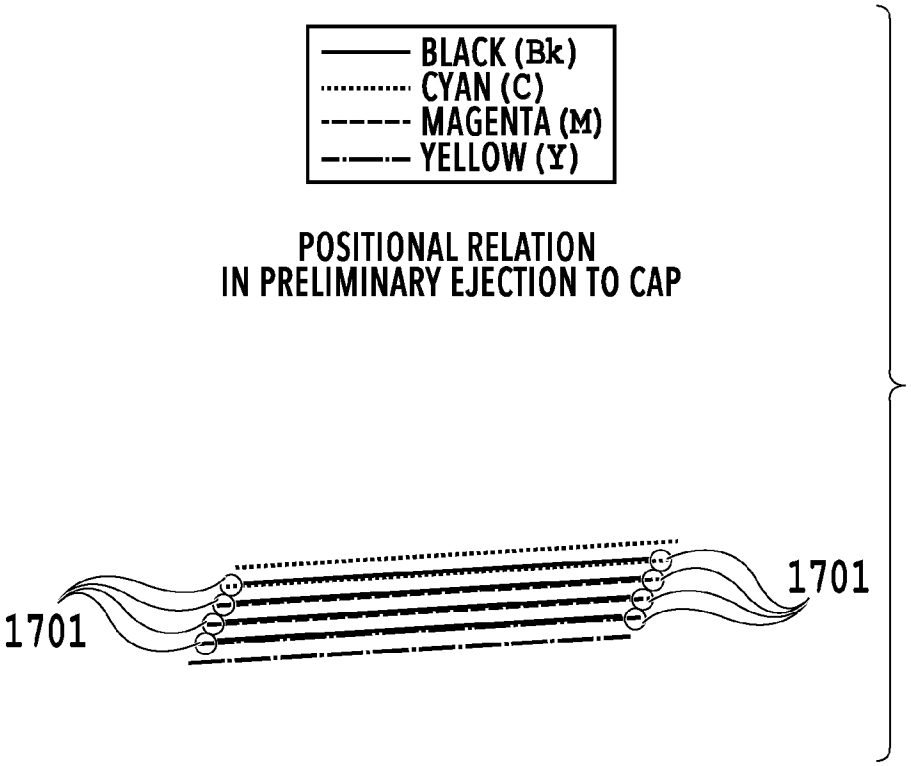
FIGS. 17A and 17B are diagrams showing an arrangement of ejection opening arrays and a positional relation in preliminary ejection.
Figure 17A:
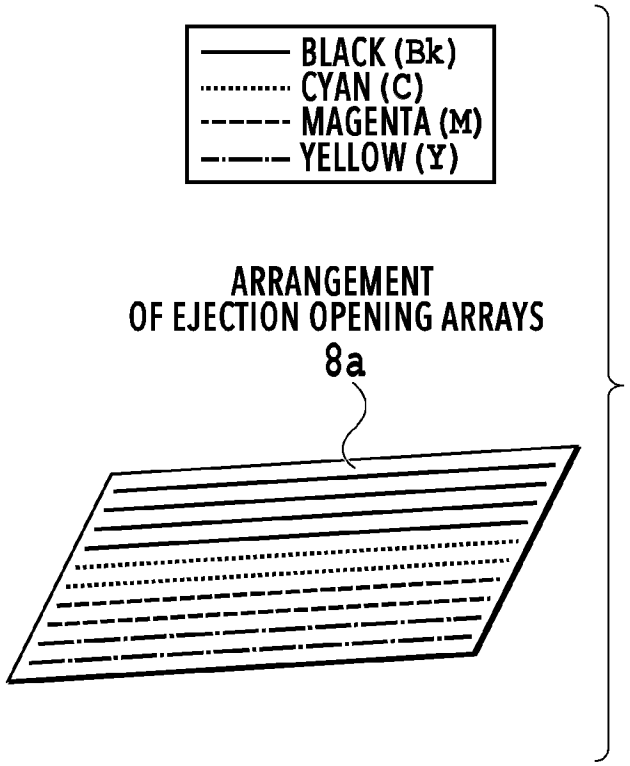

FIG. 17A is a diagram showing the arrangement of ejection opening arrays and FIG. 17B is a diagram showing the positional relation between the preliminarily ejected inks landing on the cap member 10*a*. In FIG. 17B, as shown in an area 1701, preliminary ejection is not performed for the ejection openings of black ink at the ends. Incidentally, as described in the third embodiment, the ink for which preliminary ejection is not performed is subjected to a process of making color mixing less visible by circulation.

Other Embodiments

In the above-described main embodiments, by way of example, description has been given of the aspect that preliminary ejection of black ink is performed in one relative position, that is, a second relative position. However, preliminary ejection of black ink may be performed in a plurality of relative positions. For instance, in a case where ejection opening arrays of black ink consist of a first ejection opening portion and a second ejection opening portion, preliminary ejection is performed for the first ejection opening portion in a relative position where the first ejection opening portion overlaps with an area where preliminarily ejected color ink has landed. Furthermore, preliminary ejection is performed for the second ejection opening portion in a relative position where the second ejection opening portion overlaps with the area where preliminarily ejected color ink has landed. It should be noted that there may be ejection openings which are included both in the first ejection opening portion and the second ejection opening portion. Furthermore, description has been given of the example of dividing the ejection opening arrays of black ink into two groups, but they may be divided into three or more groups, and preliminary ejection of black ink may be performed in relative positions corresponding to their respective groups. In this manner, the second relative position may correspond to the plurality of relative positions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133533, filed Jul. 7, 2017, which is hereby incorporated by reference wherein in its entirety.

What is claimed is:

1. An inkjet printing apparatus comprising:

a print head having an ejection opening surface on which a first ejection opening array capable of ejecting a first ink to a print medium and a second ejection opening array capable of ejecting a second ink to a print medium are arranged;

a cap member configured to cap the first ejection opening array and the second ejection opening array; and a print controller configured to:

(i) perform a first preliminary ejecting operation for preliminarily ejecting the first ink to the cap member in a state in which a position of the cap member relative to the print head corresponds to a first relative position;

(ii) move relatively at least one of the print head and the cap member to a second relative position;

(iii) perform a second preliminary ejecting operation for preliminarily ejecting the second ink to the cap member in a state in which a position of the cap member relative to the print head corresponds to the second relative position, the second relative position being a position in which the second ink ejected during the second preliminary ejecting operation lands in a position that overlaps with an area where the first ink ejected during the first preliminary ejecting operation lands; and (iv) perform a third preliminary ejecting operation for preliminarily ejecting the first ink to the cap member after the second preliminary ejecting operation in a state in which a position of the cap member relative to the print head corresponds to the first relative position.

2. The inkjet printing apparatus according to claim 1, wherein the first ink is color ink and the second ink is black ink.

3. The inkjet printing apparatus according to claim 1, wherein the second ink is an ink that easily accumulates compared to the first ink.

4. The inkjet printing apparatus according to claim 1, wherein a second preliminary ejection amount in the second preliminary ejecting operation is less than a total of a first preliminary ejection amount in the first preliminary ejecting operation and a third preliminary ejection amount in the third preliminary ejecting operation.

5. The inkjet printing apparatus according to claim 4, wherein the first preliminary ejection amount is greater than the third preliminary ejection amount.

6. The inkjet printing apparatus according to claim 1, further comprising a wiping member for wiping the ejection opening surface of the print head, wherein the print controller performs first preliminary ejecting operation, the second preliminary ejecting operation and the third preliminary ejecting operation after the ejection opening surface is wiped by the wiping member.

7. The inkjet printing apparatus according to claim 1, further comprising:

an ink tank for accommodating ink supplied to the print head; and a circulation unit configured to circulate ink through a circulation path including the ink tank and the print head; and a wiping member for wiping the ejection opening surface of the print head while suspending ink circulation by the circulation unit, wherein the print controller performs the first preliminary ejecting operation, the second preliminary ejecting operation and the third preliminary ejecting operation after the ejection opening surface is wiped by the wiping member, and the circulation unit starts the ink circulation after the third preliminary ejecting operation is performed.

8. The inkjet printing apparatus according to claim 7, wherein the print controller performs the second preliminary ejecting operation by using ejection openings other than an ejection opening located at an end of the second ejection opening array.

9. The inkjet printing apparatus according to claim 7, wherein the print controller performs the second preliminary ejecting operation by using ejection openings located near a center of the second ejection opening array.

10. The inkjet printing apparatus according to claim 7, wherein the first ejection opening array and the second ejection opening array are displaced from each other by a predetermined distance in a second direction perpendicular to a first direction, the first direction being a direction in which the relative position is changed.

11. The inkjet printing apparatus according to claim 7, wherein the first ejection opening array and the second ejection opening array have different lengths in a second direction perpendicular to a first direction, the first direction being a direction in which the relative position is changed.

12. The inkjet printing apparatus according to claim 7, wherein the print head has a plurality of ejection modules, each having ejection opening arrays including the first ejection opening array and the second ejection opening array extending in a direction with a predetermined angle with respect to a second direction perpendicular to a first direction, the first direction being a direction in which the relative position is changed, the plurality of ejection modules being arranged in the second direction, and an end of the ejection opening arrays of the ejection module has an area overlapping with the ejection opening arrays of an adjacent ejection module in the second direction.

13. The inkjet printing apparatus according to claim 1, further comprising a moving unit configured to move the cap member relative to the print head.

14. An ejecting method in an inkjet printing apparatus that includes a print head having an ejection opening surface on which a first ejection opening array capable of ejecting a first ink to a print medium and a second ejection opening array capable of ejecting a second ink to a print medium are arranged; and a cap member configured to cap the first ejection opening array and the second ejection opening array, the ejecting method comprising:

performing a first preliminary ejecting operation for preliminarily ejecting the first ink to the cap member in a state in which a position of the cap member relative to the print head corresponds to a first relative position, moving relatively at least one of the print head and the cap member to a second relative position;

performing a second preliminary ejecting operation for preliminarily ejecting the second ink after the first preliminary ejecting operation in a state in which a position of the cap member relative to the print head corresponds to the second relative position, the second relative position being a position in which the second ink ejected during the second preliminary ejecting operation lands in a position that overlaps with an area where the first ink ejected during the first preliminary ejecting operation lands; and performing a third preliminary ejecting operation for preliminarily ejecting the first ink to the cap member after the second preliminary ejecting operation in a state in which a position of the cap member relative to the print head corresponds to the first relative position.

15. The inkjet printing apparatus according to claim 1, wherein the first ejection opening array and the second ejection opening array are arranged in an area corresponding to a width of a print medium.

* * * * *